US011428058B2

(12) United States Patent
Haiderer et al.

(10) Patent No.: US 11,428,058 B2
(45) Date of Patent: Aug. 30, 2022

(54) FLUID DELIVERY DEVICE FOR A HYDRAULIC FRACTURING SYSTEM

(71) Applicant: SPM Oil & Gas Inc., Fort Worth, TX (US)

(72) Inventors: Jeffrey Robert Haiderer, Fort Worth, TX (US); Paul Malcolm Steele, Midlothian, TX (US); Connor Landrum, Burleson, TX (US); Scott Skurdalsvold, Fort Worth, TX (US); Justin Lane Poehls, Fort Worth, TX (US); Gideon Nathanael Spencer, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 183 days.

(21) Appl. No.: 16/767,113

(22) PCT Filed: Dec. 14, 2018

(86) PCT No.: PCT/US2018/065809
§ 371 (c)(1),
(2) Date: May 26, 2020

(87) PCT Pub. No.: WO2019/118905
PCT Pub. Date: Jun. 20, 2019

(65) Prior Publication Data

US 2020/0291731 A1 Sep. 17, 2020

Related U.S. Application Data

(60) Provisional application No. 62/598,877, filed on Dec. 14, 2017.

(51) Int. Cl.
*E21B 21/06* (2006.01)
*E21B 43/26* (2006.01)
(Continued)

(52) U.S. Cl.
CPC ..... *E21B 21/062* (2013.01); *B01F 23/4105* (2022.01); *B01F 23/49* (2022.01);
(Continued)

(58) Field of Classification Search
CPC .. B01F 2101/49; B01F 23/40; B01F 23/4105; B01F 23/49; B01F 27/00;
(Continued)

(56) References Cited

U.S. PATENT DOCUMENTS 3,766,986 A 10/1973 Kiel
4,726,219 A 2/1988 Pearson et al.
(Continued)

FOREIGN PATENT DOCUMENTS

WO WO-2018084831 A * 5/2018 ..... F04B 49/00

OTHER PUBLICATIONS

International Search Report and Written Opinion received in Patent Cooperation Treaty Application No. PCT/US2018/065809, dated Apr. 11, 2019, 9 pages.

*Primary Examiner* — James G Sayre
(74) *Attorney, Agent, or Firm* — Wei Wei Jeang; Grable Martin Fulton PLLC

(57) ABSTRACT

A syringe assembly for a hydraulic fracturing system includes a syringe having a material chamber, a base fluid chamber, and a piston. The material chamber is configured to be fluidly connected to a fluid conduit. The piston retracts to draw material into the material chamber. The piston extends to push the material into the fluid conduit. The syringe assembly includes a diverter fluidly connected to the base fluid chamber and moveable between first and second positions. The first position of the diverter fluidly connects the base fluid chamber to a base fluid reservoir of the hydraulic fracturing system and fluidly disconnects the base fluid chamber from an outlet of a frac pump of the hydraulic
(Continued)

fracturing system. The second position of the diverter fluidly connects the base fluid chamber to the outlet of the frac pump and fluidly disconnects the base fluid chamber from the base fluid reservoir.

19 Claims, 9 Drawing Sheets

(51) Int. Cl.

| | |
|---|---|
| ***E21B 33/038*** | (2006.01) |
| ***E21B 33/068*** | (2006.01) |
| ***B01F 23/40*** | (2022.01) |
| ***B01F 23/41*** | (2022.01) |
| ***B01F 35/88*** | (2022.01) |
| ***B01F 101/49*** | (2022.01) |

(52) U.S. Cl.
CPC ..... *B01F 35/88221* (2022.01); *E21B 33/038* (2013.01); *E21B 33/068* (2013.01); *E21B 43/2607* (2020.05); *B01F 2101/49* (2022.01)

(58) Field of Classification Search
CPC .. B01F 35/88221; E21B 21/06; E21B 21/062; E21B 33/038; E21B 33/068; E21B 43/26; E21B 43/2607
See application file for complete search history.

(56) References Cited

U.S. PATENT DOCUMENTS

| | | | | |
|---|---|---|---|---|
| 5,899,272 | A * | 5/1999 | Loree ..... | C09K 8/80 166/280.2 |
| 2005/0006089 | A1 | 1/2005 | Justuce et al. | |
| 2011/0272156 | A1 | 11/2011 | Johnson, Sr. | |
| 2014/0008074 | A1 | 1/2014 | Nevison | |

* cited by examiner

FLUID DELIVERY DEVICE FOR A HYDRAULIC FRACTURING SYSTEM

RELATED APPLICATION

This application is a national phase application of Patent Cooperation Treaty Application No. PCT/US2018/065809 filed Dec. 14, 2018, which claims priority to U.S. Provisional Application No. 62/598,877 filed Dec. 14, 2017.

TECHNICAL FIELD

This disclosure relates to hydraulic fracturing systems, and in particular, to fluid delivery devices for hydraulic fracturing systems.

BACKGROUND OF THE DISCLOSURE

In oilfield operations, reciprocating pumps are used for different fracturing operations such as fracturing subterranean formations to drill for oil or natural gas, cementing a wellbore, or treating the wellbore and/or formation. A reciprocating pump designed for fracturing operations is sometimes referred to as a "frac pump." A reciprocating pump typically includes a power end and a fluid end (sometimes referred to as a cylindrical section). The fluid end is typically formed of a one piece construction or a series of blocks secured together by rods. The fluid end includes a fluid cylinder having a plunger passage for receiving a plunger or plunger throw, an inlet passage that holds an inlet valve assembly, and an outlet passage that holds an outlet valve assembly.

Conventional systems used for hydraulic fracturing consist of a blender that mixes a base fluid (e.g., water, liquefied petroleum gas (LPG), propane, etc.) with one or more other materials (e.g., a slurry, sand, acid, proppant, a sand and base fluid mixture, a gel, a foam, a compressed gas, etc.) to form a fracturing fluid, which is sometimes referred to as a "fracking fluid." The fracking fluid is transported to the fluid end of the frac pump via a low-pressure line. The fluid end of the frac pump pumps the fracking fluid to the well head via a high-pressure line. Thus, the fluid end of the frac pump is currently the point of transition of the fracking fluid from low pressure to high pressure in the hydraulic fracturing system. Specifically, the fluid end brings the fracking fluid in from the low-pressure line and forces it out into the high-pressure line. The fracking fluid often contains solid particulates and/or corrosive material such that the fracking fluid can be relatively abrasive.

Over time, the flow of the abrasive fracking fluid through the fluid end of the frac pump can erode and wear down the interior surfaces (e.g., the various internal passages, etc.) and/or the internal components (e.g., valves, seats, springs, etc.) of the fluid end, which can eventually cause the fluid end of the frac pump to fail. Failure of the fluid end of a frac pump can have relatively devastating repercussions and/or can be relatively costly.

SUMMARY

This summary is provided to introduce a selection of concepts in a simplified form that are further described below in the Detailed Description. This summary is not intended to identify key features or essential features of the claimed subject matter. Nor is it intended to be used as an aid in determining the scope of the claimed subject matter.

In a first aspect, a syringe assembly for a hydraulic fracturing system is provided. The syringe assembly includes a syringe having a material chamber, a base fluid chamber, and a piston. The material chamber is configured to be fluidly connected to a fluid conduit of the hydraulic fracturing system. The piston is configured to retract to draw at least one material into the material chamber. The piston is configured to extend to push the at least one material into the fluid conduit. The syringe assembly includes a diverter fluidly connected to the base fluid chamber and moveable between first and second positions. The first position of the diverter is configured to fluidly connect the base fluid chamber to a base fluid reservoir of the hydraulic fracturing system and fluidly disconnect the base fluid chamber from an outlet of a frac pump of the hydraulic fracturing system. The second position of the diverter is configured to fluidly connect the base fluid chamber to the outlet of the frac pump and fluidly disconnect the base fluid chamber from the base fluid reservoir.

In one embodiment, the second position of the diverter is configured to approximately equalize the pressure of the base fluid chamber and the material chamber of the syringe.

In some embodiments, the second position of the diverter is configured to increase the pressure of fluid contained within the base fluid chamber of the syringe. The first position of the diverter is configured to release fluid from the base fluid chamber.

In some embodiments, the diverter includes first and second valves. The first valve is open and the second valve is closed in the first position of the diverter. The first valve is closed and the second valve is open in the second position of the diverter.

In some embodiments, the diverter includes a rod and first and second valves held on the rod. The rod reciprocates between the first and second positions of the diverter to open and close the first and second valves.

In some embodiments, the diverter includes a hydraulic actuator configured to move the diverter between the first and second positions.

In one embodiment, the diverter includes a spool valve configured to move the diverter between the first and second positions.

In some embodiments, the syringe includes an actuator configured to extend the piston.

In some embodiments, the syringe includes an actuator configured to extend the piston when the diverter is in the second position.

In a second aspect, a fluid delivery device is provided for a hydraulic fracturing system. The fluid delivery device includes a fluid conduit having a fracking fluid outlet configured to be fluidly connected to a well head for delivering a fracking fluid to the well head. The fluid conduit includes a base fluid inlet configured to be fluidly connected to an outlet of a frac pump of the hydraulic fracturing system. The fluid delivery device includes a syringe having a material chamber fluidly connected to the fluid conduit downstream from the frac pump. The material chamber is configured to be fluidly connected to a material source. The syringe includes a base fluid chamber. The syringe includes a piston that is configured to retract to draw at least one material of the fracking fluid into the material chamber from the material source. The piston is configured to extend to push the at least one material of the fracking fluid from the material chamber into the fluid conduit. The fluid delivery device includes a diverter fluidly connected to the base fluid chamber and moveable between first and second positions. The first position of the diverter is configured to fluidly connect the base fluid chamber to a base fluid reservoir of the hydraulic fracturing system and fluidly disconnect the base fluid chamber from the outlet of the frac pump. The second position of the diverter is configured to fluidly connect the base fluid chamber to the outlet of the frac pump and fluidly disconnect the base fluid chamber from the base fluid reservoir.

In some embodiments, the second position of the diverter is configured to approximately equalize the pressure of the base fluid chamber and the material chamber of the syringe.

In some embodiments, the diverter includes a rod and first and second valves held on the rod. The rod reciprocates between the first and second positions of the diverter to open and close the first and second valves.

In some embodiments, the diverter includes a hydraulic actuator configured to move the diverter between the first and second positions.

In some embodiments, the syringe includes an actuator configured to extend the piston.

In a third aspect, a method is provided for operating a syringe of a hydraulic fracturing system. The method includes fluidly connecting a base fluid chamber of the syringe with a base fluid reservoir to thereby draw at least one material of a fracking fluid into a material chamber of the syringe; fluidly connecting the base fluid chamber of the syringe with an outlet of a frac pump of the hydraulic fracturing system to approximately equalize the pressure within the base fluid chamber and the material chamber; and actuating the syringe to inject the at least one material from the material chamber into a fluid conduit when the base fluid chamber of the syringe is fluidly connected to the outlet of the frac pump.

In some embodiments, fluidly connecting the base fluid chamber of the syringe with the base fluid reservoir includes fluidly connecting the base fluid chamber to a lower pressure line, and fluidly connecting the base fluid chamber of the syringe with the outlet of the frac pump includes fluidly connecting the base fluid chamber to a higher pressure line.

In some embodiments, fluidly connecting the base fluid chamber of the syringe with the base fluid reservoir includes moving a diverter to a first position wherein a first valve of the diverter is open and a second valve of the diverter is closed, and fluidly connecting the base fluid chamber of the syringe with the outlet of the frac pump includes moving the diverter to a second position wherein the second valve is open and the first valve is closed.

In some embodiments, fluidly connecting the base fluid chamber of the syringe with the base fluid reservoir includes retracting a piston of the syringe, and actuating the syringe to inject the at least one material from the material chamber into the fluid conduit when the base fluid chamber is fluidly connected to the outlet of the frac pump includes extending the piston using an actuator of the syringe.

In some embodiments, fluidly connecting the base fluid chamber of the syringe with the base fluid reservoir includes fluidly disconnecting the base fluid chamber of the syringe from the outlet of the frac pump, and fluidly connecting the base fluid chamber of the syringe with the outlet of the frac pump includes fluidly disconnecting the base fluid chamber of the syringe from the base fluid reservoir.

In some embodiments, actuating the syringe to inject the at least one material from the material chamber into the fluid conduit when the base fluid chamber is fluidly connected to the outlet of the frac pump includes injecting the at least one material into the fluid conduit downstream from the frac pump.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments.

Corresponding reference characters indicate corresponding parts throughout the drawings.

DETAILED DESCRIPTION

Figure 1:
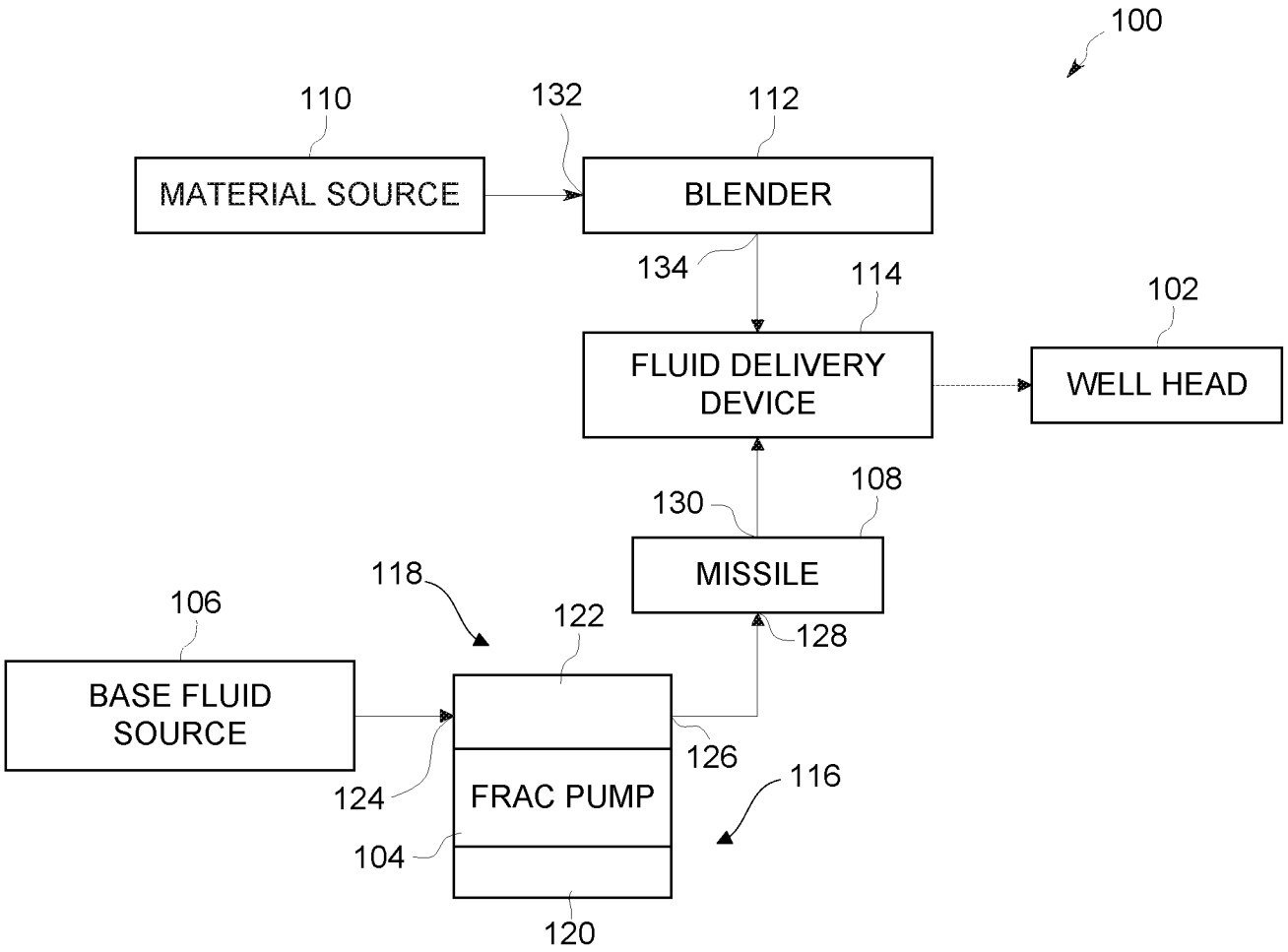
FIG. 1 is a schematic diagram of a hydraulic fracturing system according to an exemplary embodiment.

Certain embodiments of the disclosure provide a syringe assembly for a fluid delivery system that includes a syringe and a diverter that is fluidly connected to the base fluid chamber and is moveable between first and second positions. The first position of the diverter is configured to fluidly connect a base fluid chamber of the syringe to a base fluid reservoir of a hydraulic fracturing system and fluidly disconnect the base fluid chamber from an outlet of a frac pump of the hydraulic fracturing system. The second position of the diverter is configured to fluidly connect the base fluid chamber to the outlet of the frac pump and fluidly disconnect the base fluid chamber from the base fluid reservoir.

Certain embodiments of the disclosure provide a method for operating a syringe of a hydraulic fracturing system that includes fluidly connecting a base fluid chamber of the syringe with a base fluid reservoir to thereby draw at least one material of a fracking fluid into a material chamber of the syringe; fluidly connecting the base fluid chamber of the syringe with an outlet of a frac pump of the hydraulic fracturing system to approximately equalize the pressure within the base fluid chamber and the material chamber; and actuating the syringe to inject the at least one material from the material chamber into a fluid conduit when the base fluid chamber of the syringe is fluidly connected to the outlet of the frac pump.

Certain embodiments of the disclosure can mitigate the amount of relatively abrasive material that flows through the fluid end of a frac pump by introducing relatively abrasive material into a hydraulic fracturing system after the fluid end of a frac pump (i.e., downstream from the outlet of the frac pump). In some examples, the fluid end of a frac pump will pump a relatively non-abrasive base fluid (e.g., water) exclusively. Certain embodiments of the disclosure reduce wear and erosion on the interior surfaces (e.g., the various internal passages, etc.) and/or the internal components (e.g., valves, seats, springs, etc.) of the fluid end of a frac pump. Certain embodiments of the present disclosure increase (i.e., extend) the longevity and thus the operational life of the fluid ends of frac pumps.

The fluid delivery systems, syringe assemblies, and operational methods disclosed by certain embodiments herein that introduce relatively abrasive materials of a fracking fluid after the fluid end of a frac pump can provide numerous benefits over conventional systems used for hydraulic fracturing, for example the following benefits, without limitation: a fluid end of a frac pump that wears significantly less due to the lack of relatively abrasive material flowing through the fluid end; internal surfaces and/or components of a fluid end that wear significantly less due to the lack of relatively abrasive material flowing through the fluid end; gates of a hydraulic fracturing system will take on significant wear instead of the fluid end of a frac pump; and the fluid end of a frac pump will resist failure for a longer period of time.

FIG. 1 is a schematic diagram of a hydraulic fracturing system 100 according to an exemplary embodiment. The hydraulic fracturing system 100 is used to pump a fracking fluid into the well head 102 of a wellbore (not shown) for performing a fracturing operation, for example fracturing a subterranean formation to drill for oil or natural gas, cementing the wellbore, treating the wellbore and/or formation, etc. The hydraulic fracturing system 100 includes a frac pump 104, one or more base fluid sources 106, an optional missile 108, one or more material sources 110, a blender 112, and a fluid delivery device 114. Although only one is shown in FIG. 1, the hydraulic fracturing system 100 can include any number of the fluid delivery devices 114.

The base fluid source 106 includes a tank, reservoir, and/or other container that holds a base fluid of the fracking fluid. As will be described below, the base fluid is mixed with one or more other materials to form the fracking fluid. The base fluid of the base fluid source 106 can be any fluid that is relatively non-abrasive, for example, water, liquefied petroleum gas (LPG), propane, and/or the like. In some examples, the base fluid is relatively non-corrosive. Although only one is shown in FIG. 1, the hydraulic fracturing system 100 can include any number of the base fluid sources 106. According to some embodiments, one or more of the base fluid sources 106 is freestanding on the ground, mounted to a trailer for towing between operational sites, mounted to a skid, loaded on a manifold, otherwise transported, and/or the like.

The frac pump 104 includes a power end portion 116 and a fluid end portion 118 operably coupled thereto. The power end portion 116 includes a crankshaft (not shown) that is driven by an engine or motor 120. The fluid end portion 118 includes a fluid end block or fluid cylinder 122 that includes an inlet 124 fluidly connected to the base fluid source 106 and an outlet 126 fluidly connected to the fluid delivery device 114 (e.g., via the missile 108 as described below). In operation, the engine or motor 120 turns the crankshaft, which reciprocates a plunger rod assembly (not shown) between the power end portion 116 and the fluid end portion 118 to thereby pump (i.e., move) a flow of the base fluid from the base fluid source 106 into the inlet 124, through the fluid cylinder 122, and out the outlet 126 to the fluid delivery device 114 (e.g., via the missile 108 as described below). Thus, the inlet 124 defines a lower-pressure side of the frac pump 104 while the outlet 126 defines a higher-pressure side of the frac pump 104. In some examples, the frac pump 104 is freestanding on the ground, mounted to a trailer for towing between operational sites, mounted to a skid, loaded on a manifold, otherwise transported, and/or the like. Although only a single frac pump 104 is shown in FIG. 1, the hydraulic fracturing system 100 can include any number of frac pumps 104.

The missile 108 is a fluid manifold that is fluidly connected between the frac pump 104 and the fluid delivery device 114 for delivering the base fluid from the frac pump 104 to the fluid delivery device 114. More particularly, the missile 108 includes an inlet 128 fluidly connected to the outlet 126 of the frac pump 104 and an outlet 130 fluidly connected to the fluid delivery device 114. The missile 108 can be freestanding on the ground, mounted to a trailer for towing between operational sites, mounted to a skid, loaded on a manifold, otherwise transported, and/or the like. Optionally, the missile 108 returns fracking fluid that has been pumped into the wellbore by the hydraulic fracturing system 100 to a tank, reservoir, and/or other container (e.g., the base fluid source 106) and/or the frac pump 104. For example, a lower-pressure side of the missile 108 can fluidly connected to the inlet 124 of the frac pump 104. The missile 108 is sometimes referred to as a "zipper".

As described above, the missile 108 is an optional component of the hydraulic fracturing system 100. Accordingly, in some embodiments one or more frac pumps 104 is directly fluidly connected to a corresponding fluid delivery device 114. More particularly, the outlet 126 of a frac pump 104 of the hydraulic fracturing system 100 can be directly fluidly connected to a corresponding fluid delivery device 114 to thereby pump (i.e., move) a flow of the base fluid through the fluid cylinder 122 and out the outlet 126 of the frac pump 104 directly to the fluid delivery device 114.

The material source 110 includes a tank, reservoir, and/or other container that holds one or more materials that are mixed with the base fluid to form the fracking fluid that is delivered to the well head 102 by the hydraulic fracturing system 100. The material(s) held by the material source 110 can include any material(s) that can be mixed with the base fluid to form a fracking fluid that is suitable for performing a fracturing operation, for example a slurry, sand, acid, proppant, a sand and base fluid mixture, a gel, a foam, a compressed gas, and/or the like. The hydraulic fracturing system 100 can include any number of the material sources 110, each of which can hold any number of different materials. According to some embodiments, one or more of the material sources 110 is freestanding on the ground, mounted to a trailer for towing between operational sites, mounted to a skid, loaded on a manifold, otherwise transported, and/or the like.

The blender 112 is configured to deliver a flow of one or more materials from the material source(s) 110 to the fluid delivery device 110. More particularly, the blender 112 includes an inlet 132 fluidly connected to the material source(s) 110 and an outlet 134 fluidly connected to the fluid delivery device 114. The blender 112 can mix two or more materials from two or more different material sources 110 together for delivery to the fluid delivery device 114. In some examples, the blender 112 is fluidly connected to a base fluid source 106 or another source of base fluid for mixing base fluid with one or more materials from one or more material sources 110 for delivery to the fluid delivery device 114. Moreover, in some examples the blender 112 mixes base fluid (whether from the base fluid source 106 or another source) with one or more materials from one or more different material sources 110 to form a finished (i.e., complete) fracking fluid that is ready for delivery to the fluid delivery device 114. Optionally, the blender 112 includes a pump (not shown) and/or other device for delivering the flow of material(s) to the fluid delivery device 114.

The blender 112 can be freestanding on the ground, mounted to a trailer for towing between operational sites, mounted to a skid, loaded on a manifold, otherwise transported, and/or the like. The hydraulic fracturing system 100 can include any number of blenders 112. The blender 112 and the material source 110 may each be referred to herein as a "material source". For example, the "material source" recited in the claims of the present disclosure may refer to the blender 112 and/or one or more material sources 110.

Figure 2:
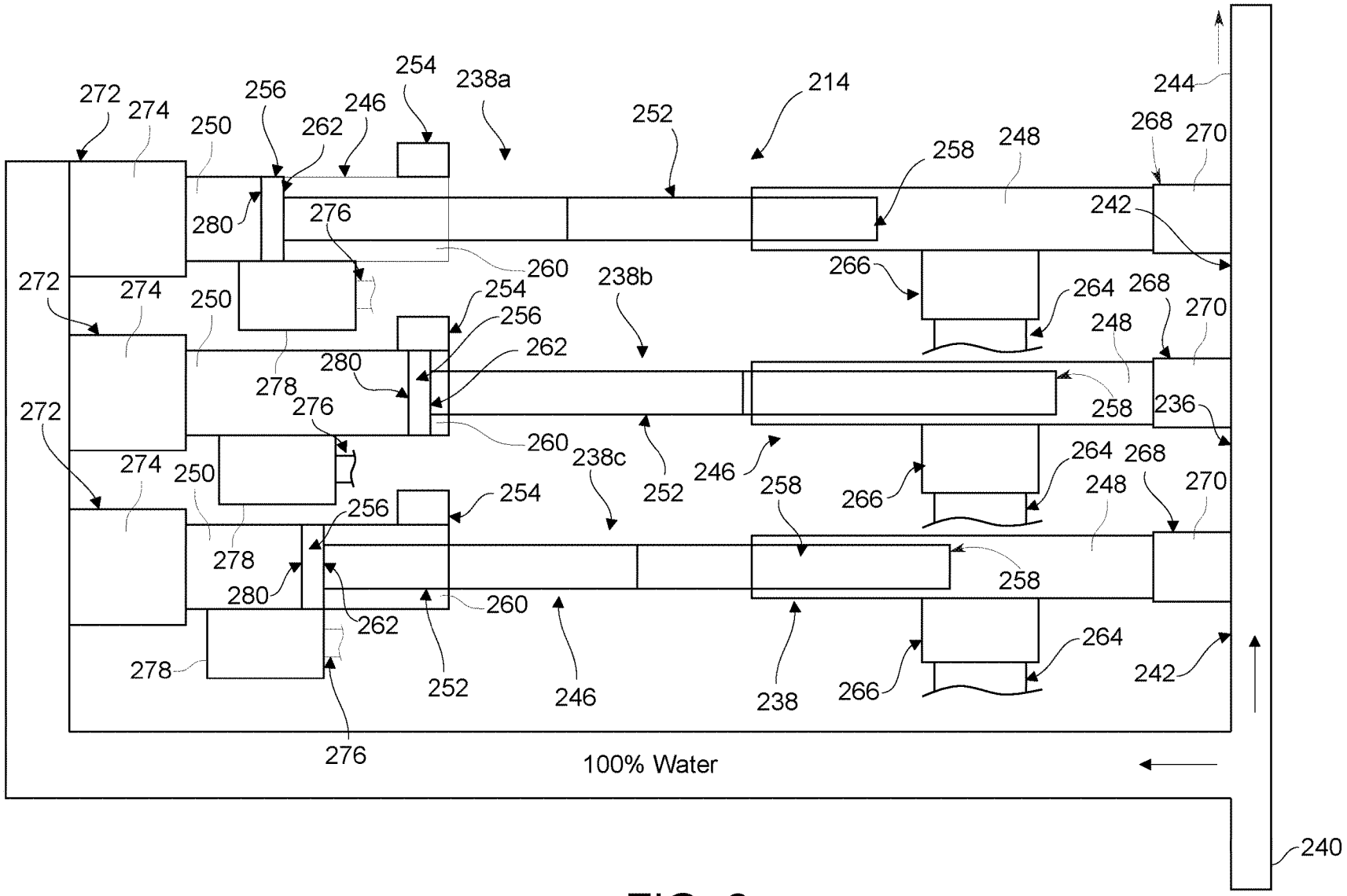
FIG. 2 is a schematic diagram of a fluid delivery device of the hydraulic fracturing system shown in FIG. 1 according to an exemplary embodiment.

FIG. 2 is a schematic diagram of another fluid delivery device 214 that can be used with the hydraulic fracturing system 100 (FIG. 1) according to an exemplary embodiment. The fluid delivery device 214 includes a fluid conduit 236 and one or more injection systems 238. In the exemplary embodiment of the fluid delivery device 214, three injection systems 238*a*, 238*b*, and 238*c* are provided. But, the fluid delivery device 214 can include any number of injection systems 238. According to some embodiments, the fluid delivery device 214 is mounted on a trailer, freestanding on the ground, mounted to a skid, loaded on a manifold, otherwise transported, and/or the like.

The fluid conduit 236 includes a base fluid inlet 240, a mixing segment 242, and a fracking fluid outlet 244. The base fluid inlet 240 is configured to be fluidly connected to the outlet 126 (FIG. 1) of the frac pump 104 (FIG. 1) for receiving the flow of base fluid from the frac pump 104. The base fluid inlet 240 defines a higher-pressure entrance of the fluid delivery device 214. For example, the base fluid inlet 240 defines a higher-pressure inlet of the fluid conduit 236 that receives the flow of base fluid from the higher-pressure side (i.e., the outlet 126) of the frac pump 104. The base fluid inlet 240 can be indirectly fluidly connected to the outlet 126 of the frac pump 104 via the missile 108 (FIG. 1) or can be directly fluidly connected to the outlet 126 of the frac pump 104.

Each injection system 238 is configured to inject at least one material of the fracking fluid (e.g., from the blender 112 shown in FIG. 1, directly from one or more material sources 110 shown in FIG. 1, etc.) into the mixing segment 242 of the fluid conduit 236 to generate the fracking fluid within the mixing segment 242. The fracking fluid outlet 244 is configured to be directly or indirectly fluidly connected to the well head 102 (FIG. 1) for delivering a flow of the fracking fluid to the well head 102. The fracking fluid outlet 244 defines a higher-pressure outlet of the fluid conduit 236. Accordingly, the fracking fluid outlet 244 defines a higher-pressure exit of the fluid delivery device 214.

Each injection system 238 includes a syringe 246 that includes a material chamber 248, a base fluid chamber 250, a piston 252, and an actuator 254. The piston 252 includes a piston head 256 that extends within the base fluid chamber 250 and a piston ram 258 that extends within the material chamber 248. The piston 252 is configured to move between an extended position and a retracted position such that the piston ram 258 extends and retracts within the material chamber 248, as can be seen in FIG. 2. For example, the piston ram 258 of the injection system 238*a* is shown in FIG. 2 in the retracted position, while the piston ram 258 of the injection system 238*b* is shown in an extended position in FIG. 2. Operation of the piston 252 will be described in more detail below.

The actuator 254 is operatively connected to the piston 252 such that the actuator 254 is configured to move the piston 252 from the extended position to the retracted position. In the exemplary embodiment of the fluid delivery device 214, the actuator 254 is a hydraulic oil pump that is configured to move hydraulic oil into a hydraulic oil chamber 260 such that the hydraulic oil exerts a force on a side 262 of the piston head 256 that moves the piston 252 from the extended position to the retracted position. The actuator 254 is not limited to being a hydraulic oil pump, but rather additionally or alternatively can include any type of actuator that is capable of moving the piston 252 from the extended position to the retracted position, for example an electric motor, a linear actuator (e.g., a ball screw, a lead screw, a rotary screw, a solenoid, etc.), and/or the like.

The material chamber 248 of the syringe 246 of each injection system 238 includes a material inlet 264 that is fluidly connected to the outlet 134 (FIG. 1) of the blender 112 for receiving a flow of at least one material of the fracking fluid from the blender 112. The material inlet 264 defines a lower-pressure entrance of the fluid delivery device 214. For example, the material inlet 264 defines a lower-pressure inlet of the material chamber 248. The material inlet 264 includes a material inlet valve 266 that controls the flow of material(s) from the blender 112 through the material inlet 264 into the material chamber 248 of the syringe 246. Specifically, the material inlet valve 266 is moveable between an open position and a closed position. The open position of the material inlet valve 266 enables material(s) to flow from the blender 112 through the material inlet 264 into the material chamber 248. The closed position of the material inlet valve 266 prevents material(s) from the blender 112 from flowing through the material inlet 264 into the material chamber 248.

In the exemplary embodiment of the fluid delivery device 214, the material inlet valve 266 is a check valve that is moved between the open and closed positions via pressure differentials across the valve 266, as will be described below. In other examples, movement of the material inlet valve 266 between the open and closed positions is controlled by the control system of the hydraulic fracturing system 100 (e.g., based on a position of the piston ram 258, based on a predetermined timing scheme, based on a particle count sensor (not shown) within the material chamber 248, based on another sensor (not shown) within the material chamber 248, etc.). In addition or alternatively to a check valve, the material inlet valve 266 can include any other type of valve (e.g., an integrated circuit (IC) driven valve, a programmable logic control (PLC) driven valve, another electrically controlled valve, etc.) that enables the hydraulic fracturing system 100 to function as described and/or illustrated herein.

Although described herein as being indirectly fluidly connected to the material source(s) 110 via the blender 112, the material inlet 264 of the material chamber 248 of each syringe 246 can be directly fluidly connected to one or more of the material sources 110 for receiving a flow of at least one material of the fracking fluid directly therefrom. Optionally, the material inlets 264 of the material chambers 248 include a common entrance (not shown).

The material chamber 248 of the syringe 246 of each injection system 238 includes a material outlet 268 that is fluidly connected to the mixing segment 242 of the fluid conduit 236. Accordingly, the material outlet 268 is fluidly connected to the fluid conduit 236 downstream from the base fluid inlet 240 and thus downstream from the frac pump 104, as is shown herein. The material outlet 268 defines a higher-pressure outlet of the fluid conduit 236. Accordingly, the material outlet 268 defines a higher-pressure exit of the fluid delivery device 214.

The material outlet 268 includes a material outlet valve 270 that controls the flow of material(s) from the material chamber 248 of the syringe 246 through the material outlet 268 into the mixing segment 242 of the fluid conduit 236. Specifically, the material outlet valve 270 is moveable between an open position and a closed position. The open position of the material outlet valve 270 enables material(s) to flow from the material chamber 248 through the material outlet 268 into the mixing segment 242 of the fluid conduit 236. The closed position of the material outlet valve 270 prevents material(s) from the material chamber 248 from flowing through the material outlet 268 into the mixing segment 242 of the fluid conduit 236.

In the exemplary embodiment of the fluid delivery device 214, the material outlet valve 270 is a check valve that is moved between the open and closed positions via pressure differentials across the valve 270, as will be described below. In other examples, movement of the material outlet valve 270 between the open and closed positions is controlled by the control system of the hydraulic fracturing system 100 (e.g., based on a position of the piston ram 258, based on a predetermined timing scheme, based on a particle count sensor within the material chamber 248, based on another sensor within the material chamber 248, etc.). In addition or alternatively to a check valve, the material outlet valve 270 can include any other type of valve (e.g., an integrated circuit (IC) driven valve, a programmable logic control (PLC) driven valve, another electrically controlled valve, etc.) that enables the hydraulic fracturing system 100 to function as described and/or illustrated herein.

The base fluid chamber 250 of the syringe 246 of each injection system 238 includes a base fluid inlet 272 that is configured to be fluidly connected to the outlet 126 of the frac pump 104 for receiving a flow of base fluid from the frac pump 104. The base fluid inlet 272 can be indirectly fluidly connected to the outlet 126 of the frac pump 104 via the missile 108 or can be directly fluidly connected to the outlet 126 of the frac pump 104. The base fluid inlet 272 defines a higher-pressure entrance of the fluid delivery device 214. For example, the base fluid inlet 272 defines a higher-pressure inlet of the base fluid chamber 250. The base fluid inlet 272 includes a base fluid inlet valve 274. The base fluid inlet valve 274 controls the flow of base fluid into the base fluid chamber 250 of the syringe 246. More particularly, the base fluid inlet valve 274 is moveable between an open position that enables base fluid to through the base fluid inlet 272 into the base fluid chamber 250 and a closed position that prevents base fluid from the frac pump 104 from flowing through the base fluid inlet 272 into the base fluid chamber 250.

Movement of the base fluid inlet valve 274 between the open and closed positions can be controlled by the control system of the hydraulic fracturing system 100. In some examples, movement of the base fluid inlet valve 274 between the open and closed positions is based on a position of the piston head 256. In other examples, movement of the base fluid inlet valve 274 between the open and closed positions is based on a predetermined timing scheme, a particle count sensor within the material chamber 248, another sensor within the material chamber 248, and/or the like. In the exemplary embodiment of the fluid delivery device 214, the base fluid inlet valve 274 is a hydraulic fill valve. But, additionally or alternatively the base fluid inlet valve 274 can include any other type of valve (e.g., an integrated circuit (IC) driven valve, a programmable logic control (PLC) driven valve, another electrically controlled valve, etc.) that enables the hydraulic fracturing system 100 to function as described and/or illustrated herein. Optionally, the base fluid inlets 272 include a common entrance (not shown).

The base fluid chamber 250 of the syringe 246 of each injection system 238 includes a base fluid outlet 276 for discharging base fluid from the base fluid chamber 250 during retraction of the piston 252. Optionally, the base fluid outlet 276 is fluidly connected to the inlet 124 (FIG. 1) of the frac pump 104, the inlet 128 (FIG. 1) of the missile 108, and/or one or more of the base fluid sources 106 for returning base fluid thereto from the base fluid chamber 250. The frac pump 104, the missile 108, and the base fluid source(s) 106 may each be referred to herein as a "base fluid reservoir". For example, the "base fluid reservoir" recited in the claims of the present disclosure may refer to the frac pump 104, the missile 108, and/or one or more base fluid sources 106.

The base fluid outlet 276 defines a lower-pressure exit of the fluid delivery device 214. For example, the base fluid outlet 276 defines a lower-pressure outlet of the base fluid chamber 250. The base fluid outlet 276 includes a base fluid outlet valve 278 that controls the flow of base fluid out of the base fluid chamber 250 through the base fluid outlet 276. Specifically, the base fluid outlet valve 278 is moveable between an open position that enables base fluid to flow out of the base fluid chamber 250 through the base fluid outlet 276 and a closed position that prevents base fluid from flowing out of the base fluid chamber 250 through the base fluid outlet 276.

In some examples, movement of the base fluid outlet valve 278 between the open and closed positions is based on a pressure differential across the valve 278 (e.g., the valve 278 is a check valve). In other examples, movement of the base fluid outlet valve 278 between the open and closed positions is based on a predetermined timing scheme, a particle count sensor within the material chamber 248, another sensor within the material chamber 248, a position of the piston head 256, and/or the like. Movement of the base fluid outlet valve 278 between the open and closed positions can be controlled by the control system of the hydraulic fracturing system 100. In the exemplary embodiment of the fluid delivery device 214, the base fluid outlet valve 278 is a hydraulic bleed valve. But, additionally or alternatively the base fluid outlet valve 274 can include any other type of valve (e.g., an IC driven valve, a PLC driven valve, another electrically controlled valve, etc.) that enables the hydraulic fracturing system 100 to function as described and/or illustrated herein. Optionally, the base fluid chambers 250 include a common entrance (not shown).

Operation of the syringe 240 of the injection system 238*a* will now be described to provide a general understanding of the operation of the fluid delivery device 214. The operation of the syringes 240 of each of the injections systems 238 is substantially similar such that the operational description of the injection system 238*a* should be understood as being representative of the operation of the injection systems 238*b* and 238*b*.

At the beginning of a cycle, the actuator 254 moves the piston 252 to the retracted position thereby creating a lower-pressure suction that opens the material inlet valve 266 and draws one or more materials of the fracking fluid from the blender 112 into the material chamber 248 through the material inlet 264. Movement of the piston 252 toward the retracted position also opens the base fluid outlet valve 278 such that base fluid within the base fluid chamber 250 is discharged therefrom through the base fluid outlet 276. In the exemplary embodiment, the suction within the material chamber 248 and/or a bias of the material outlet valve 270 to the closed position closes (or maintains as closed) the material outlet valve 270 during retraction of the piston 252. The base fluid inlet valve 274 is also in the closed position during movement of the piston 252 toward the retracted position.

Once the piston 252 reaches a fully retracted position, the base fluid outlet valve 278 closes and the base fluid inlet valve 274 opens such that base fluid from the outlet 126 of the frac pump 104 flows into the base fluid chamber 250. The pressure exerted by the flow of base fluid on a side 280 of the piston head 256 is effectively greater than the pressure exerted on the opposite side 262 of the piston head 256 by the hydraulic oil, which causes the piston 252 to move from the retracted position to the extended position. As the piston 252 moves to the extended position, the piston ram 258 pressurizes the material(s) from the blender 112 contained within the material chamber 248 such that the material outlet valve opens 270 opens and the material(s) contained within the material chamber 248 discharge (i.e., are injected) into the mixing segment 242 through the material outlet 268 to thereby generate the fracking fluid within the mixing segment 242 for delivery to the well head 102 through the fracking fluid outlet 244. Accordingly, the syringe 240 injects the material(s) into the fluid conduit 236 downstream from the frac pump 104. In the exemplary embodiment, the pressure within the material chamber 248 and/or a bias of the material inlet valve 266 to the closed position closes the material outlet inlet valve 266 at the onset of extension of the piston 252.

Once the material(s) drawn into the material chamber 248 from the blender 112 have been discharged into the mixing segment 242 of the fluid conduit 236, the base fluid inlet valve 274 closes and the actuator 254 can retract the piston 252 to repeat the cycle of the syringe 246 drawing the material(s) from the blender 112 into the material chamber 248 and injecting the material(s) into the mixing segment 242 to generate the fracking fluid within the fluid conduit 236.

In some examples, the material(s) injected into the mixing segment 242 from the material chamber 248 mix with base fluid flowing through the mixing segment 242 to form (i.e., generate) the fracking fluid within the mixing segment 242. In other examples, the material(s) injected into the mixing segment 242 from the material chamber 248 define a finished (i.e., complete) fracking fluid that is ready for delivery to the well head 102. Although the fluid delivery device 214 is described herein as delivering a fracking fluid to the well head 102, in other examples the fluid delivery device 214 can be used to transport, divert, convey, or otherwise move one or more solid materials (e.g., sand, sandstone, ceramic beads, sintered bauxite, aluminum, other oil and gas well stimulation proppant, etc.) to the well head 102.

Various parameters of the injection system 238 can be selected such that the effective pressure exerted on the side 280 of the piston head 256 by the base fluid is greater than the pressure exerted on the opposite side 262 by the hydraulic oil when the base fluid inlet valve 274 is open, for example the surface area of the side 280 as compared to the side 262, the pressure of the base fluid within the base fluid chamber 250 created by the frac pump 104 as compared to the resting pressure the hydraulic oil within the hydraulic oil chamber 260, and/or the like.

Using two or more injection systems 238 (and/or two or more fluid delivery devices 214) can enable the fluid delivery device(s) 214 to deliver a substantially continuous flow of fracking fluid to the well head 102 during operation of the hydraulic fracturing system 100. More particularly, the syringes 246 of the injection systems 238 (and/or two or more fluid delivery devices 214) can be cycled between injection phases in an offset timing pattern, for example as is shown in FIG. 2. The ability of the fluid delivery device(s) 214 to deliver a substantially continuous supply of the fracking fluid to the well head 102 mitigates the potential for base fluid that has not been mixed with any other materials of the fracking fluid to flow into the well head 102.

The hydraulic fracturing system 100 can include any number of the fluid delivery devices 214 (each of which can include any number of the injection systems 238) to facilitate delivering a substantially continuous flow of fracking fluid to the well head 102. Non-limiting examples include a fluid delivery device 214 having two, three, four, five, ten, or twenty injection systems 238 timed to deliver a substantially continuous flow of fracking fluid to the well head 102. Other non-limiting examples include two, three, four, five, ten, or twenty fluid delivery devices 214 (each of which can include any number of the injection systems 238) timed to deliver a substantially continuous flow of fracking fluid to the well head 102.

Figure 3:
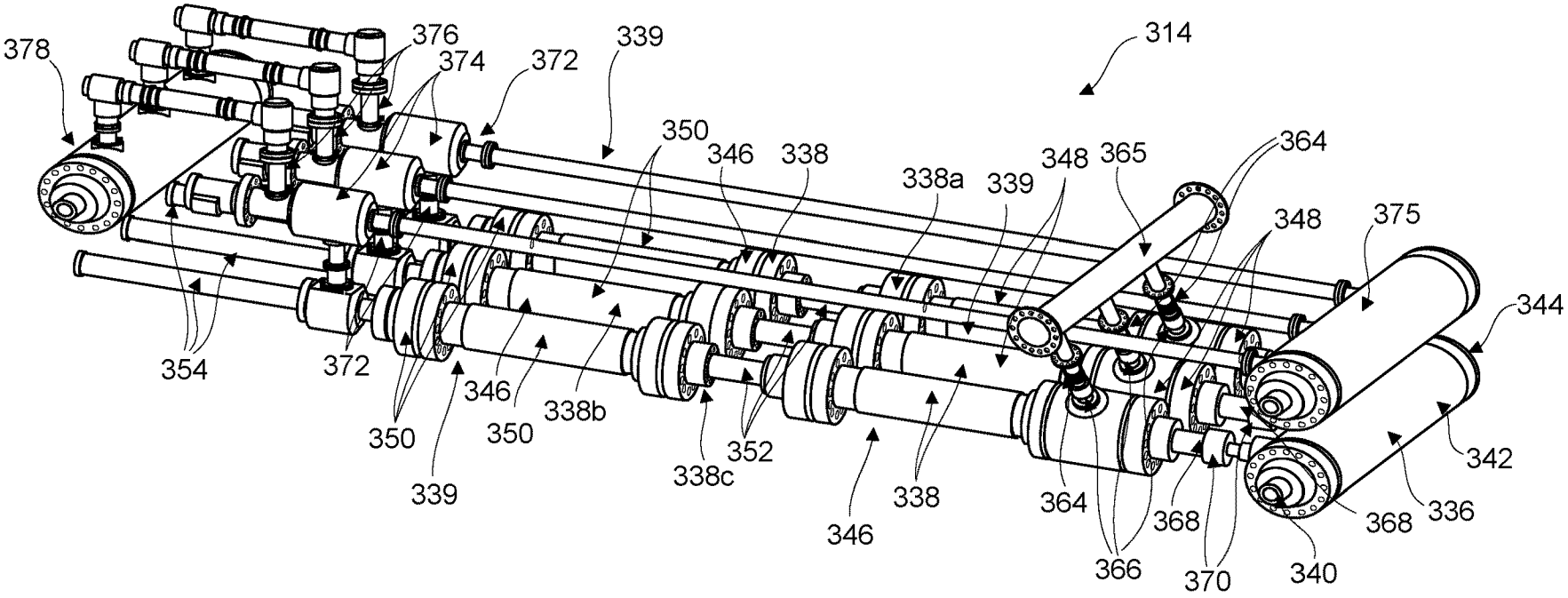
FIG. 3 is a perspective view of another fluid delivery device of the hydraulic fracturing system shown in FIG. 1 according to an exemplary embodiment.

FIG. 3 is a perspective view of another fluid delivery device 314 that can be used with the hydraulic fracturing system 100 (FIG. 1) according to an exemplary embodiment. The fluid delivery device 314 includes a fluid conduit 336 and one or more injection systems 338. In the exemplary embodiment of the fluid delivery device 314, three injection systems 338*a*, 338*b*, and 338*c* are provided. But, the fluid delivery device 314 can include any number of injection systems 338. According to some embodiments, the fluid delivery device 314 is mounted on a trailer, freestanding on the ground, mounted to a skid, loaded on a manifold, otherwise transported, and/or the like.

The fluid conduit 336 includes a base fluid inlet 340, a mixing segment 342, and a fracking fluid outlet 344. The base fluid inlet 340 is configured to be fluidly connected to the outlet 126 (FIG. 1) of the frac pump 104 (FIG. 1) for receiving the flow of base fluid from the frac pump 104. The base fluid inlet 340 defines a higher-pressure entrance of the fluid delivery device 314. For example, the base fluid inlet 340 defines a higher-pressure inlet of the fluid conduit 336 that receives the flow of base fluid from the higher-pressure side (i.e., the outlet 126) of the frac pump 104. The base fluid inlet 340 can be indirectly fluidly connected to the outlet 126 of the frac pump 104 via the missile 108 (FIG. 1) or can be directly fluidly connected to the outlet 126 of the frac pump 104.

Each injection system 338 is configured to inject at least one material of the fracking fluid (e.g., from the blender 112 shown in FIG. 1, directly from one or more material sources 110 shown in FIG. 1, etc.) into the mixing segment 342 of the fluid conduit 336 to generate the fracking fluid within the mixing segment 342. The fracking fluid outlet 344 is configured to be directly or indirectly fluidly connected to the well head 102 (FIG. 1) for delivering a flow of the fracking fluid to the well head 102. The fracking fluid outlet 344 defines a higher-pressure outlet of the fluid conduit 336. Accordingly, the fracking fluid outlet 344 defines a higher-pressure exit of the fluid delivery device 314.

Figure 4:
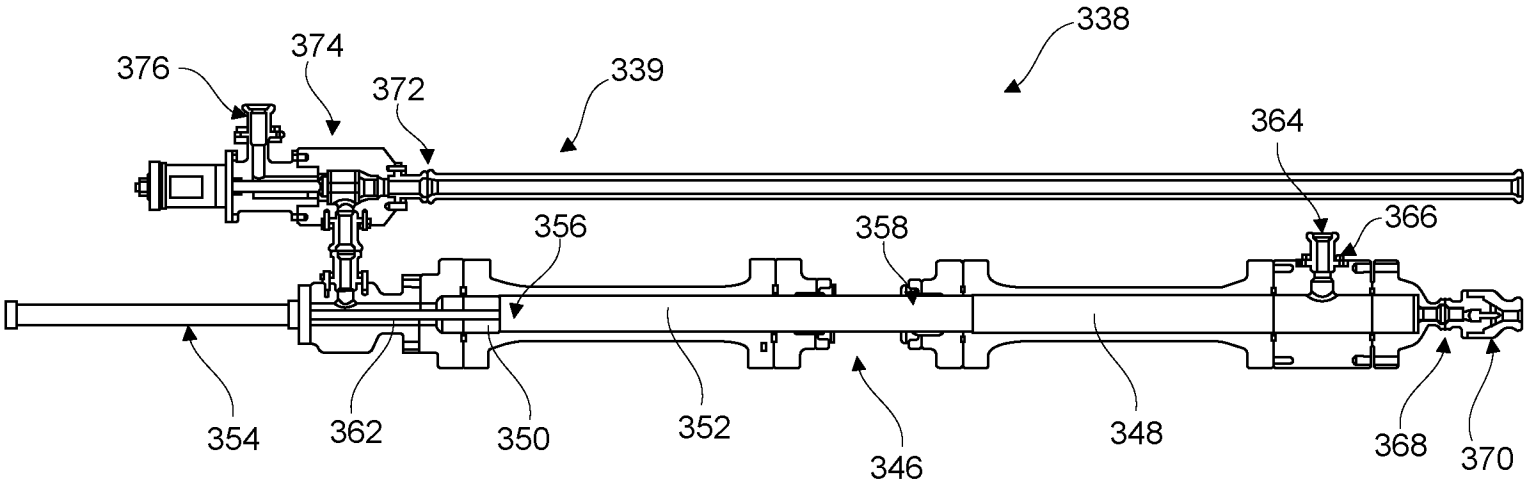
FIG. 4 is a cross-sectional view of an injection system of the fluid delivery device shown in FIG. 2 according to an exemplary embodiment.

Referring now to FIGS. 3 and 4, each injection system 338 includes a syringe assembly 339 that includes a syringe 346 and a diverter 374. The diverter 374 will be described in more detail below. The syringe 346 includes a material chamber 348, a base fluid chamber 350, a piston 352, and an actuator 354. The piston 352 includes a piston head 356 (not visible in FIG. 3) that extends within the base fluid chamber 350 and a piston ram 358 (not visible in FIG. 3) that extends within the material chamber 348. The piston 352 is configured to move between an extended position and a retracted position such that the piston ram 358 extends and retracts within the material chamber 348, as should be apparent from FIG. 4. For example, the piston ram 358 of the injection system 338 is shown in FIG. 4 in the retracted position. Operation of the piston 252 will be described in more detail below.

The actuator 354 is operatively connected to the piston 352 such that the actuator 354 is configured to move the piston 352 from the retracted position to the extended position. In the exemplary embodiment of the fluid delivery device 314, the actuator 354 is a hydraulic actuator that is configured to move a rod 362 (not visible in FIG. 3) that is connected to the piston head 356 to thereby move the piston 352 from the retracted position to the extended position. In some examples, the actuator 354 is a hydraulic spool valve. The actuator 354 is not limited to being a hydraulic spool valve or any other type of hydraulic actuator (e.g., a hydraulic pump system, etc.), but rather additionally or alternatively can include any type of actuator that is capable of moving the piston 352 from the retracted position to the extended position, for example an electric motor, a linear actuator (e.g., a ball screw, a lead screw, a rotary screw, another screw-type actuator, a hydraulic linear actuator, a pneumatic linear actuator, a solenoid, a servo, another type of linear actuator, etc.), a pneumatic actuator, a servo, and/or the like.

The material chamber 348 of the syringe 346 of each injection system 338 includes a material inlet 364 that is fluidly connected to the outlet 134 (FIG. 1) of the blender 112 for receiving a flow of at least one material of the tracking fluid from the blender 112. The material inlet 364 defines a lower-pressure entrance of the fluid delivery device 314. For example, the material inlet 364 defines a lower-pressure inlet of the material chamber 348. The material inlet 364 includes a material inlet valve 366 that controls the flow of material(s) from the blender 112 through the material inlet 364 into the material chamber 348 of the syringe 346. Specifically, the material inlet valve 366 is moveable between an open position and a closed position. The open position of the material inlet valve 366 enables material(s) to flow from the blender 112 through the material inlet 364 into the material chamber 348. The closed position of the material inlet valve 366 prevents material(s) from the blender 112 from flowing through the material inlet 364 into the material chamber 348.

In the exemplary embodiment of the fluid delivery device 314, the material inlet valve 366 is a check valve that is moved between the open and closed positions via pressure differentials across the valve 366, as will be described below. In other examples, movement of the material inlet valve 366 between the open and closed positions is controlled by the control system of the hydraulic fracturing system 100 (e.g., based on a position of the piston ram 358, based on a predetermined timing scheme, based on a particle count sensor (not shown) within the material chamber 348, based on another sensor (not shown) within the material chamber 348, etc.). In addition or alternatively to a check valve, the material inlet valve 366 can include any other type of valve (e.g., an integrated circuit (IC) driven valve, a programmable logic control (PLC) driven valve, another electrically controlled valve, etc.) that enables the hydraulic fracturing system 100 to function as described and/or illustrated herein.

Although described herein as being indirectly fluidly connected to the material source(s) 110 via the blender 112, the material inlet 364 of the material chamber 348 of each syringe 346 can be directly fluidly connected to one or more of the material sources 110 for receiving a flow of at least one material of the fracking fluid directly therefrom. In the exemplary embodiment of the fluid delivery device 314, the material inlets 364 are shown in FIG. 3 as including a common entrance 365 for fluid connection with the blender 112 and/or the material source(s) 110. But, in other examples one or more of the material inlets 364 can include a dedicated entrance for a separate fluid connection with the blender 112 and/or material source(s) 110.

The material chamber 348 of the syringe 346 of each injection system 338 includes a material outlet 368 that is fluidly connected to the mixing segment 342 of the fluid conduit 336. Accordingly, the material outlet 368 is fluidly connected to the fluid conduit 336 downstream from the base fluid inlet 340 and thus downstream from the frac pump 104, as is shown herein. The material outlet 368 defines a higher-pressure outlet of the fluid conduit 336. Accordingly, the material outlet 368 defines a higher-pressure exit of the fluid delivery device 314.

The material outlet 368 includes a material outlet valve 370 that controls the flow of material(s) from the material chamber 348 of the syringe 346 through the material outlet 368 into the mixing segment 342 of the fluid conduit 336. Specifically, the material outlet valve 370 is moveable between an open position and a closed position. The open position of the material outlet valve 370 enables material(s) to flow from the material chamber 348 through the material outlet 368 into the mixing segment 342 of the fluid conduit 336. The closed position of the material outlet valve 370 prevents material(s) from the material chamber 348 from flowing through the material outlet 368 into the mixing segment 342 of the fluid conduit 336.

In the exemplary embodiment of the fluid delivery device 314, the material outlet valve 370 is a check valve that is moved between the open and closed positions via pressure differentials across the valve 370. In other examples, movement of the material outlet valve 370 between the open and closed positions is controlled by the control system of the hydraulic fracturing system 100 (e.g., based on a position of the piston ram 358, based on a predetermined timing scheme, based on a particle count sensor within the material chamber 348, based on another sensor within the material chamber 348, etc.). In addition or alternatively to a check valve, the material outlet valve 370 can include any other type of valve (e.g., an integrated circuit (IC) driven valve, a programmable logic control (PLC) driven valve, another electrically controlled valve, etc.) that enables the hydraulic fracturing system 100 to function as described and/or illustrated herein.

The base fluid chamber 350 of the syringe 346 of each injection system 338 includes a base fluid inlet 372 that is configured to be fluidly connected to the outlet 126 of the frac pump 104 for receiving a flow of base fluid from the frac pump 104. The base fluid inlet 372 can be indirectly fluidly connected to the outlet 126 of the frac pump 104 via the missile 108 or can be directly fluidly connected to the outlet 126 of the frac pump 104. The base fluid inlet 372 defines a higher-pressure entrance of the fluid delivery device 214.

For example, the base fluid inlet 372 defines a higher-pressure inlet of the base fluid chamber 350. In the exemplary embodiment of the fluid delivery device 314, the base fluid inlets 372 are shown in FIG. 3 as including a common entrance 375 for fluid connection with outlet 126 of the frac pump 104. But, in other examples one or more of the base fluid inlets 372 can include a dedicated entrance for a separate fluid connection with the outlet 126 of the frac pump 104.

The base fluid chamber 350 of the syringe 346 of each injection system 338 includes a base fluid outlet 376 for discharging base fluid from the base fluid chamber 350 during retraction of the piston 352. Optionally, the base fluid outlet 376 is fluidly connected to the inlet 124 (FIG. 1) of the frac pump 104, the inlet 128 (FIG. 1) of the missile 108, and/or one or more of the base fluid sources 106 for returning base fluid thereto from the base fluid chamber 350. The frac pump 104, the missile 108, and the base fluid source(s) 106 may each be referred to herein as a "base fluid reservoir". For example, the "base fluid reservoir" recited in the claims of the present disclosure may refer to the frac pump 104, the missile 108, and/or one or more base fluid sources 106.

The base fluid outlet 376 defines a lower-pressure exit of the fluid delivery device 314. For example, the base fluid outlet 376 defines a lower-pressure outlet of the base fluid chamber 350. In the exemplary embodiment of the fluid delivery device 314, the base fluid outlets 376 are shown in FIG. 3 as including a common exit 378 for fluid connection with the inlet 124 of the frac pump 104, the inlet 128 of the missile 108, and/or the base fluid source(s) 106. But, in other examples one or more of the base fluid outlets 376 can include a dedicated entrance for a separate fluid connection with the inlet 124 of the frac pump 104, the inlet 128 of the missile 108, and/or the base fluid source(s) 106.

Figure 5:
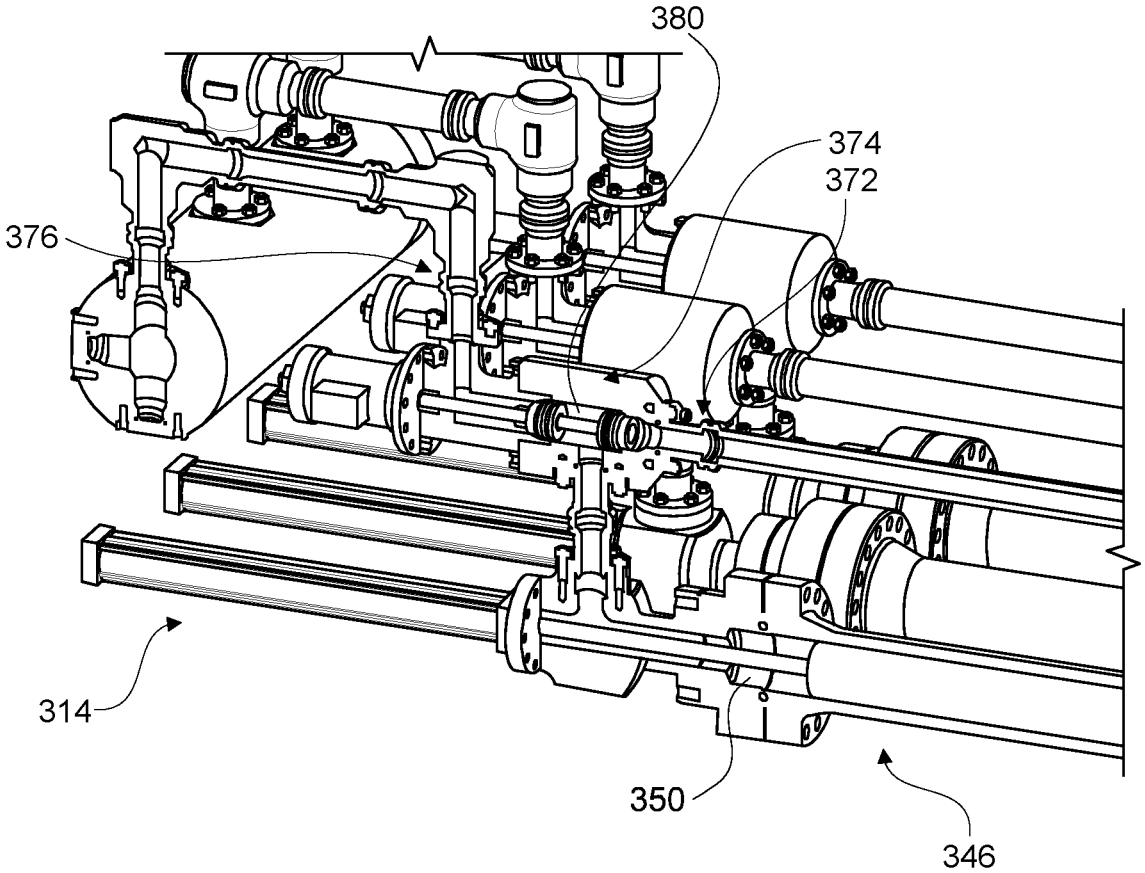
FIG. 5 is a perspective view illustrating a cross section of a portion of the fluid delivery device shown in FIG. 3 according to an exemplary embodiment.

Referring now to FIG. 5, the diverter 374 will now be described. The diverter 374 is fluidly connected to the base fluid chamber 350 of the syringe 346 between the base fluid chamber 350 and the base fluid inlet 372 and between the base fluid chamber 350 and the base fluid outlet 376. More particularly, the diverter 374 includes an interior chamber 380 that is fluidly connected to the base fluid chamber 350. As can be seen in FIG. 5, the interior chamber 380 of the diverter 374 is fluidly connected to the base fluid inlet 372 and is fluidly connected to the base fluid outlet 376.

Figure 6:
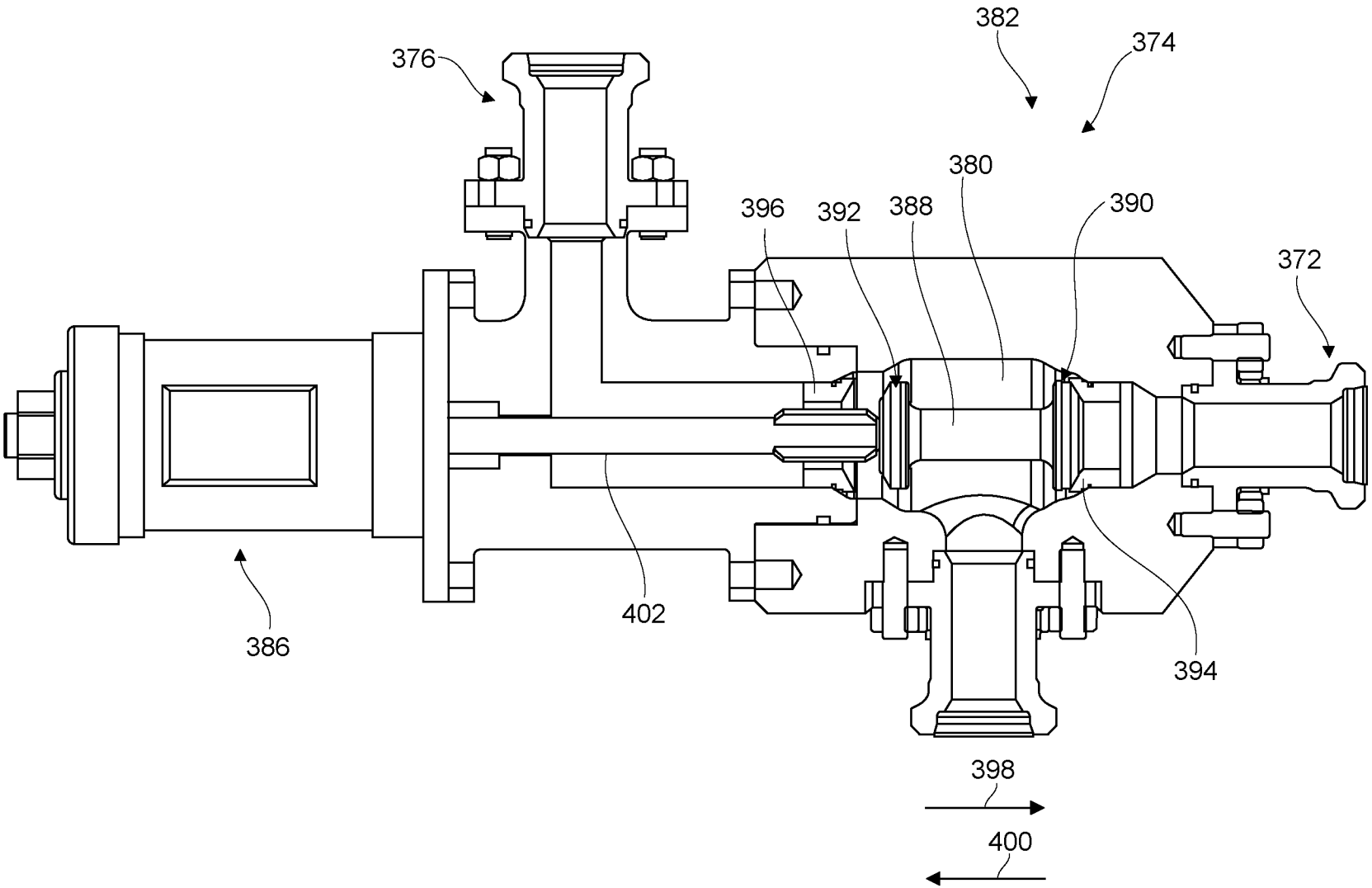
FIG. 6 is a cross-sectional view of a diverter of the injection system shown in FIG. 4 according to an exemplary embodiment illustrating the diverter in a first position.
Figure 7:
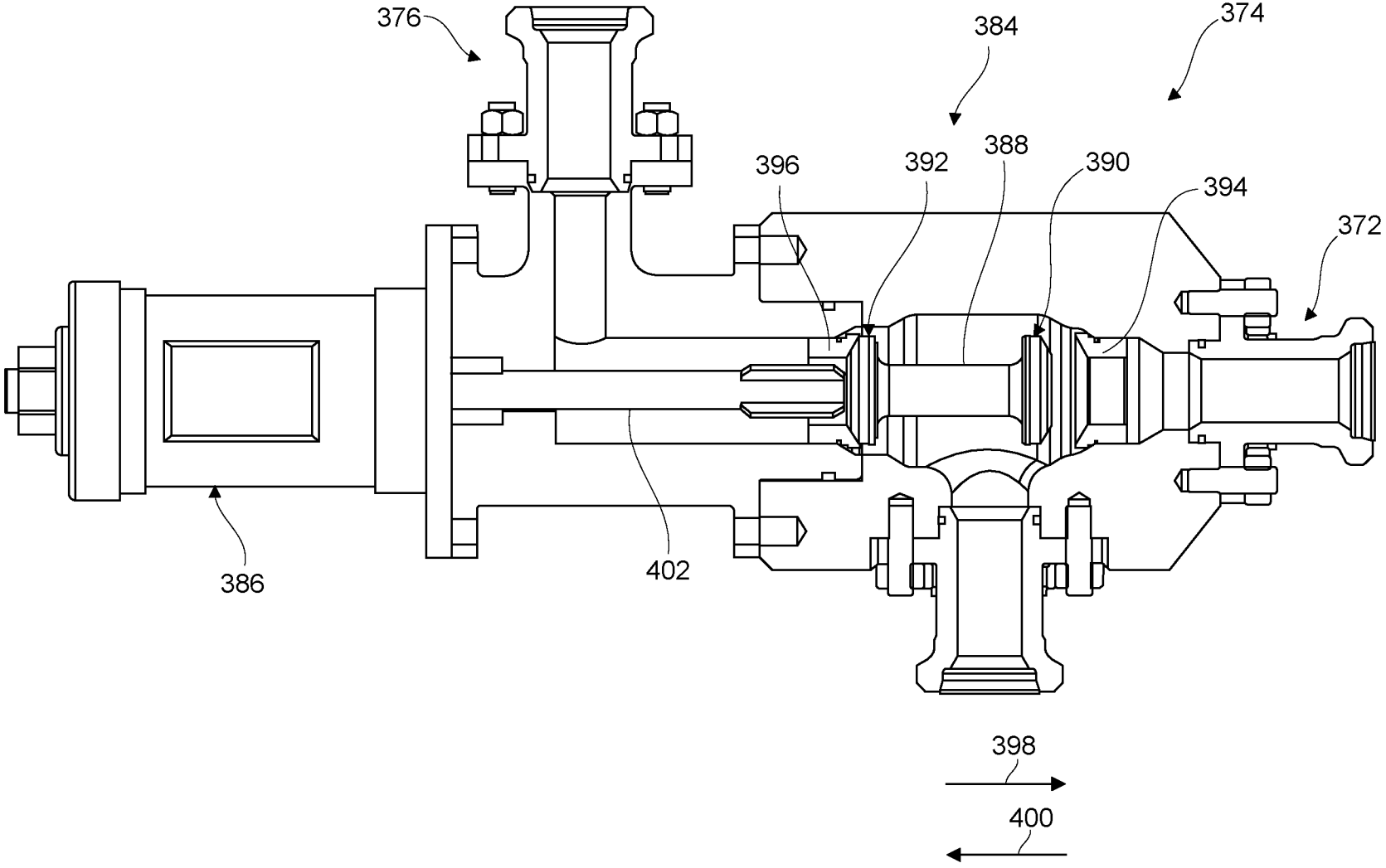
FIG. 7 is a cross-sectional view of the diverter shown in FIG. 6 illustrating the diverter in a second position.

Referring now to FIGS. 5-7, the diverter 374 controls the flow of base fluid into the base fluid chamber 350 (not shown in FIGS. 6 and 7) of the syringe 346 through the base fluid inlet 372. The diverter 374 also controls the flow of base fluid out of the base fluid chamber 350 through the base fluid outlet 376. More particularly, the diverter 374 is moveable between a first position 382 (shown in FIG. 6) and a second position 384 (shown in FIG. 7). In the first position 382, the fluid connection of the interior chamber 380 to the base fluid outlet 376 is open and the fluid connection of the interior chamber 380 to the base fluid inlet 372 is closed. Accordingly, the first position 382 of the diverter 374 enables base fluid to flow out of the base fluid chamber 350 through the base fluid outlet 376 and prevents base fluid from flowing into the base fluid chamber 350 through the base fluid inlet 372. In other words, the first position 382 of the diverter 374 fluidly connects base fluid chamber 350 to a base fluid reservoir (e.g., the inlet 124 (FIG. 1) of the frac pump 104 (FIG. 1), the inlet 128 (FIG. 1) of the missile 108 (FIG. 1), and/or one or more of the base fluid sources 106 (FIG. 1), etc.) of the hydraulic fracturing system 100 (FIG. 1) and fluidly disconnects the base fluid chamber 350 from the outlet 126 (FIG. 1) of the frac pump 104. The first position 382 of the diverter 374 thus fluidly connects the base fluid chamber 350 to a lower pressure line of the hydraulic fracturing system 100.

In the second position 384 of the diverter 374, the fluid connection of the interior chamber 380 to the base fluid inlet 372 is open and the fluid connection of the interior chamber 380 to the base fluid outlet 376 is closed. Accordingly, the second position 384 of the diverter 374 enables base fluid to flow into the base fluid chamber 350 through the base fluid inlet 372 and prevents base fluid from flowing out of the base fluid chamber 350 through the base fluid outlet 376. In other words, the second position 384 of the diverter 374 fluidly connects base fluid chamber 350 to the outlet 126 of the frac pump 104 and fluidly disconnects the base fluid chamber 350 from the base fluid reservoir of the hydraulic fracturing system 100. The second position 384 of the diverter 374 thus fluidly connects the base fluid chamber 350 to a higher pressure line of the hydraulic fracturing system 100.

Referring now solely to FIGS. 6 and 7, the diverter 374 can have any structure that enables the diverter 374 to function as described and/or illustrated herein. In the exemplary embodiment, the diverter 374 includes an actuator 386, a spool rod 388, a base fluid inlet valve 390, and a base fluid outlet valve 392. As can be seen in FIGS. 6 and 7, the spool rod 388 is held within the interior chamber 380 of the diverter 374 and the base fluid inlet and outlet valves 390 and 392, respectively, are held on the spool rod 388. The spool rod 388 reciprocates within the interior chamber 380 between the first position 382 shown in FIG. 6 and the second position 384 shown in FIG. 7 to thereby open and close the valves 390 and 392. In the first position 382 of the diverter 374 shown in FIG. 6, the base fluid inlet valve 390 is engaged with an inlet valve seat 394 of the diverter 374 such that the base fluid inlet valve 390 is closed, while the base fluid outlet valve 392 is separated from an outlet valve seat 396 of the diverter 374 such that the base fluid outlet valve 392 is open. In the second position 384 of the diverter 374 shown in FIG. 7, the base fluid inlet valve 390 is separated from the inlet valve seat 394 such that the base fluid inlet valve 390 is open, while the base fluid outlet valve 392 is engaged with the outlet valve seat 396 such that the base fluid outlet valve 392 is closed. The base fluid outlet valve 392 may be referred to herein (e.g., in the claims of the present disclosure) as a "first valve", while the base fluid inlet valve 390 may be referred to herein as a "second valve".

The actuator 386 is operatively connected to the spool rod 388 such that the actuator 386 is configured to reciprocate the spool rod 388 between the first and second positions 382 and 384, respectively, of the diverter 374. More particularly, the actuator 386 is configured to move the spool rod 388 in the direction of the arrow 398 to position the valves 390 and 392 of the diverter 374 into the first position 382 of the diverter 374; and the actuator 386 is configured to move the spool rod 388 in the direction of the arrow 400 to position the valves 390 and 392 of the diverter 374 into the second position 384 of the diverter 374. In the exemplary embodiment, the actuator 386 includes a rod 402 that is connected to the spool rod 388 such that movement of the rod 402 in the directions of the arrows 398 and 400 reciprocates the spool rod 388 within the interior chamber 380. But, the actuator 386 additionally or alternatively can include any other arrangement, configuration, structure, and/or the like that enables the actuator 386 to reciprocate the spool rod 388 within the interior chamber 380 of the diverter 374.

In the exemplary embodiment, the actuator 386 is a hydraulic actuator. In some examples, the actuator 386 is a hydraulic spool valve. But, the actuator 386 additionally or alternatively can include any other type of hydraulic actuator (e.g., a hydraulic pump system, a hydraulic linear actuator, etc.). Moreover, the actuator 386 is not limited to being a hydraulic actuator. Rather, additionally or alternatively the actuator 386 can include any type of actuator that is capable of moving the spool rod 388 of the diverter 374 between the first and second positions 382 and 384, respectively. For example, the actuator 386 can include an electric motor, a linear actuator (e.g., a ball screw, a lead screw, a rotary screw, another screw-type actuator, a pneumatic linear actuator, a solenoid, a servo, another type of linear actuator, etc.), a pneumatic actuator, a servo, and/or the like.

Movement of the diverter 374 between the first position 382 and the second position 384 can be controlled by the control system of the hydraulic fracturing system 100. In some examples, movement of the diverter 374 between the first position 382 and the second position 384 is based on a position of the piston head 356. In other examples, movement of the diverter 374 between the first position 382 and the second position 384 is based on a predetermined timing scheme, a particle count sensor within the material chamber 348, another sensor within the material chamber 348, and/or the like. In some examples, movement of the diverter 374 between the first position 382 and the second position 384 is electronically controlled (e.g., using an integrated circuit (IC), a programmable logic control (PLC), another electrical control, etc.).

In addition or alternatively to the specific arrangement, configuration, structure, and/or the like shown and/or described herein (e.g., the actuator 386, the spool rod 388, the rod 402, the valve 390, the valve 392, the seat 394, the seat 396, the interior chamber 380, etc.), the diverter 374 can have any other arrangement, configuration, structure, and/or the like that enables the diverter 374 to function as described and/or illustrated herein.

Referring now to FIGS. 1-7, operation of the syringe 346 of the injection system 338*a* will now be described to provide a general understanding of the operation of the fluid delivery device 314. The operation of the syringes 346 of each of the injections systems 338 is substantially similar such that the operational description of the injection system 338*a* should be understood as being representative of the operation of the injection systems 338*b* and 338*b*.

At the beginning of a cycle, the diverter 374 is moved to the first position 382 shown in FIG. 6 to fluidly connect the base fluid chamber 350 of the syringe 346 with the lower pressure line of a base fluid reservoir (e.g., the inlet 124 (FIG. 1) of the frac pump 104 (FIG. 1), the inlet 128 (FIG. 1) of the missile 108 (FIG. 1), and/or one or more of the base fluid sources 106 (FIG. 1), etc.) of the hydraulic fracturing system 100. Movement of the diverter 374 to the first position 382 also fluidly disconnects the base fluid chamber 350 from the outlet 126 of the frac pump 100. The lower-pressure within the base fluid chamber 350 retracts the piston 352 of the syringe 346, thereby creating a lower-pressure suction within the material chamber 348 of the syringe 346 that opens the material inlet valve 366 and draws one or more materials of the tracking fluid from the blender 112 into the material chamber 348 through the material inlet 364. The fluid connection of the base fluid chamber 350 to the lower pressure line of the base fluid reservoir, as well as the retraction of the piston 352, discharges (i.e., releases) base fluid from the base fluid chamber 350 through the base fluid outlet 376. In the exemplary embodiment, the suction within the material chamber 348 and/or a bias of the material outlet valve 370 to the closed position closes (or maintains as closed) the material outlet valve 370 during retraction of the piston 352.

Once the piston 352 reaches a fully retracted position, the diverter 374 is moved to the second position 384 shown in FIG. 7 to fluidly connect the base fluid chamber 350 with the higher pressure line of the outlet 126 of the frac pump 104 and fluidly disconnect that base fluid chamber 350 from the base fluid reservoir. The fluid connection between the base fluid chamber 350 and the outlet 126 of the frac pump 104 enables base fluid from the outlet 126 of the frac pump 104 to flow into the base fluid chamber 350 and thereby increase the pressure within the base fluid chamber 350 such that the pressure within the base fluid chamber 350 is approximately equalized with the pressure within the material chamber 348 of the syringe 346. Once the pressure within the chambers 348 and 350 is approximately equal via the movement of the diverter 374 to the second position, the actuator 354 is actuated to extend the piston 352 (i.e., move the piston 352 from the retracted position to the extended position). In other words, the actuator 354 extends the piston 352 while (i.e., when) the diverter 374 is in the second position 384. As the piston 352 moves to the extended position, the piston ram 358 pressurizes the material(s) from the blender 112 contained within the material chamber 348 such that the material outlet valve opens 370 opens and the material(s) contained within the material chamber 348 discharge (i.e., are injected) into the mixing segment 342 of the fluid conduit 336 through the material outlet 368. The syringe 346 thereby generates the fracking fluid within the mixing segment 342 for delivery to the well head 102 through the fracking fluid outlet 344. Accordingly, the syringe 346 injects the material(s) into the fluid conduit 336 downstream from the frac pump 104. In the exemplary embodiment, the pressure within the material chamber 348 and/or a bias of the material inlet valve 366 to the closed position closes the material outlet inlet valve 366 at the onset of extension of the piston 352.

Once the material(s) drawn into the material chamber 348 from the blender 112 have been discharged into the mixing segment 342 of the fluid conduit 336, the diverter 374 is moved from the second position 384 back to the first position 382 to repeat the cycle of the syringe 346 drawing the material(s) from the blender 112 into the material chamber 348 and injecting the material(s) into the mixing segment 342 to generate the fracking fluid within the fluid conduit 336.

In some examples, the material(s) injected into the mixing segment 342 from the material chamber 348 mix with base fluid flowing through the mixing segment 342 to form (i.e., generate) the fracking fluid within the mixing segment 342. In other examples, the material(s) injected into the mixing segment 342 from the material chamber 348 define a finished (i.e., complete) fracking fluid that is ready for delivery to the well head 102. Although the fluid delivery device 314 is described herein as delivering a fracking fluid to the well head 102, in other examples the fluid delivery device 314 can be used to transport, divert, convey, or otherwise move one or more solid materials (e.g., sand, sandstone, ceramic beads, sintered bauxite, aluminum, other oil and gas well stimulation proppant, etc.) to the well head 102.

Using two or more injection systems 338 (and/or two or more fluid delivery devices 314) can enable the fluid delivery device(s) 314 to deliver a substantially continuous flow of fracking fluid to the well head 102 during operation of the hydraulic fracturing system 100. More particularly, the syringes 346 of the injection systems 338 (and/or two or more fluid delivery devices 314) can be cycled between injection phases in an offset timing pattern. The ability of the fluid delivery device(s) 314 to deliver a substantially continuous supply of the fracking fluid to the well head 102 mitigates the potential for base fluid that has not been mixed with any other materials of the fracking fluid to flow into the well head 102.

The hydraulic fracturing system 100 can include any number of the fluid delivery devices 314 (each of which can include any number of the injection systems 338) to facilitate delivering a substantially continuous flow of fracking fluid to the well head 102. Non-limiting examples include a fluid delivery device 314 having two, three, four, five, ten, or twenty injection systems 338 timed to deliver a substantially continuous flow of fracking fluid to the well head 102. Other non-limiting examples include two, three, four, five, ten, or twenty fluid delivery devices 314 (each of which can include any number of the injection systems 338) timed to deliver a substantially continuous flow of fracking fluid to the well head 102.

Figure 8:
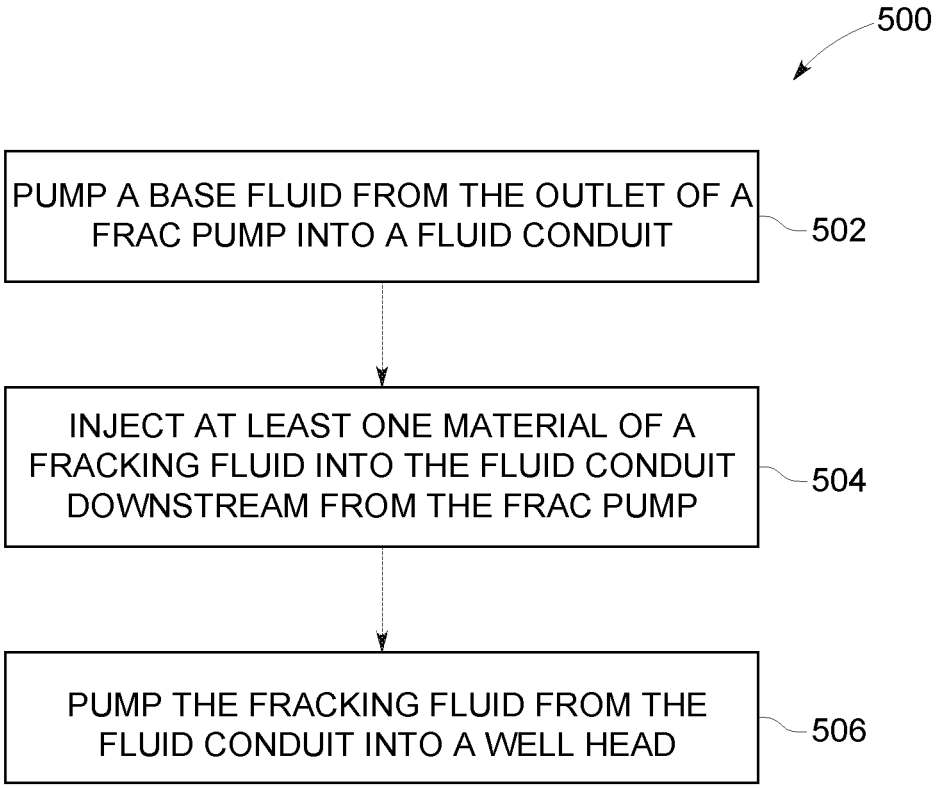
FIG. 8 is an exemplary flowchart illustrating a method for operating a hydraulic fracturing system according to an exemplary embodiment.

Referring now to FIG. 8, a method 500 for operating a hydraulic fracturing system according to an exemplary embodiment is shown. At step 502, the method 500 includes pumping a base fluid from the outlet of a frac pump into a fluid conduit. The method 500 includes injecting, at 504, at least one material of a fracking fluid into the fluid conduit downstream from the frac pump to generate the fracking fluid within the fluid conduit. At step 506, the method 500 includes pumping the fracking fluid from the fluid conduit into a well head.

The steps of the method 500 can be performed in any order. For example, injecting at 504 the at least one material of the fracking fluid into the fluid conduit can be performed before any base fluid is pumped at 502 into the fluid conduit, wherein the step of pumping at 506 the fracking fluid from the fluid conduit into the well head can include pumping at 502 the base fluid from the outlet of the frac pump into the fluid conduit.

Figure 9:
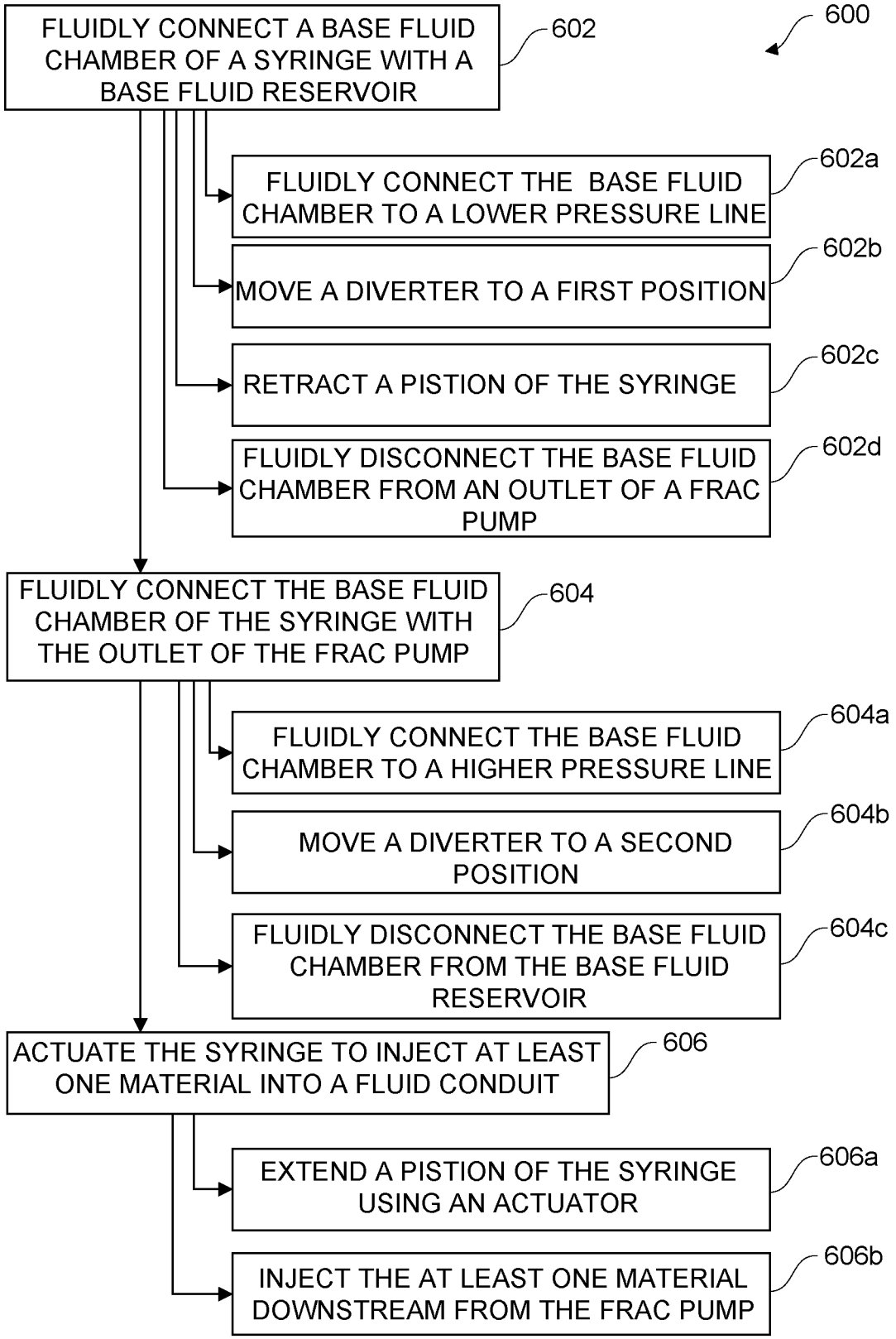
FIG. 9 is an exemplary flowchart illustrating another method for operating a hydraulic fracturing system according to an exemplary embodiment.

Referring now to FIG. 9, a method 600 for operating a syringe of a hydraulic fracturing system according to an exemplary embodiment is shown. At step 602, the method 600 includes fluidly connecting a base fluid chamber of the syringe with a base fluid reservoir to thereby draw at least one material of a fracking fluid into a material chamber of the syringe. The method step 602 includes fluidly connecting, at 602*a*, the base fluid chamber to a lower pressure line. The method step 602 includes moving, at 602*b*, a diverter to a first position wherein a first valve of the diverter is open and a second valve of the diverter is closed. At 602*c*, the method step 602 includes retracting a piston of the syringe. The method step 602 includes fluidly disconnecting, at 602*d*, the base fluid chamber of the syringe from the outlet of the frac pump.

At step 604, the method 600 includes fluidly connecting the base fluid chamber of the syringe with an outlet of a frac pump of the hydraulic fracturing system to approximately equalize the pressure within the base fluid chamber and the material chamber. The method step 604 includes fluidly connecting, at 604*a*, the base fluid chamber to a higher pressure line. At step 604*b*, the method step 604 includes moving the diverter to a second position wherein the second valve is open and the first valve is closed. At step 604*c*, the method step 604 includes fluidly disconnecting the base fluid chamber of the syringe from the base fluid reservoir.

The method 600 includes actuating, at 606, the syringe to inject the at least one material from the material chamber into a fluid conduit when the base fluid chamber of the syringe is fluidly connected to the outlet of the frac pump. At step 606*a*, the method step 606 includes extending the piston of the syringe using an actuator of the syringe. At step 606*b*, the method step 606 includes injecting the at least one material into the fluid conduit downstream from the frac pump.

The syringe assemblies, fluid delivery devices, and operational methods described and/or illustrated herein can mitigate the amount of relatively abrasive material that flows through the fluid end of a frac pump by introducing relatively abrasive material into a hydraulic fracturing system after the fluid end of a frac pump (i.e., downstream from the outlet of the frac pump). In some examples, the fluid end of a frac pump will pump a relatively non-abrasive base fluid (e.g., water) exclusively. The syringe assemblies, fluid delivery devices, and operational methods described and/or illustrated herein reduce wear and erosion on the interior surfaces (e.g., the various internal passages, etc.) and/or the internal components (e.g., valves, seats, springs, etc.) of the fluid end of a frac pump. The syringe assemblies, fluid delivery devices, and operational methods described and/or illustrated herein increase (i.e., extend) the longevity and thus the operational life of the fluid ends of frac pumps.

The syringe assemblies, fluid delivery devices, and operational methods described and/or illustrated herein that introduce relatively abrasive materials of a fracking fluid after the fluid end of a frac pump can provide numerous benefits over conventional systems used for hydraulic fracturing, for example the following benefits, without limitation: a fluid end of a frac pump that wears significantly less due to the lack of relatively abrasive material flowing through the fluid end; internal surfaces and/or components of a fluid end that wear significantly less due to the lack of relatively abrasive material flowing through the fluid end; gates of a hydraulic fracturing system will take on significant wear instead of the fluid end of a frac pump; and the fluid end of a frac pump will resist failure for a longer period of time.

The following clauses describe further aspects of the disclosure:

Clause Set A:

A1. A syringe assembly for a hydraulic fracturing system, said syringe assembly comprising:

a syringe having a material chamber, a base fluid chamber, and a piston, the material chamber being configured to be fluidly connected to a fluid conduit of the hydraulic fracturing system, the piston being configured to retract to draw at least one material into the material chamber, the piston being configured to extend to push the at least one material into the fluid conduit; and a diverter fluidly connected to the base fluid chamber and moveable between first and second positions, wherein the first position of the diverter is configured to fluidly connect the base fluid chamber to a base fluid reservoir of the hydraulic fracturing system and fluidly disconnect the base fluid chamber from an outlet of a frac pump of the hydraulic fracturing system, and wherein the second position of the diverter is configured to fluidly connect the base fluid chamber to the outlet of the frac pump and fluidly disconnect the base fluid chamber from the base fluid reservoir.

A2. The syringe assembly of clause A1, wherein the second position of the diverter is configured to approximately equalize the pressure of the base fluid chamber and the material chamber of the syringe.

A3. The syringe assembly of clause A1, wherein the second position of the diverter is configured to increase the pressure of fluid contained within the base fluid chamber of the syringe, the first position of the diverter being configured to release fluid from the base fluid chamber.

A4. The syringe assembly of clause A1, wherein the diverter comprises first and second valves, the first valve being open and the second valve being closed in the first position of the diverter, the first valve being closed and the second valve being open in the second position of the diverter.

A5. The syringe assembly of clause A1, wherein the diverter comprises a rod and first and second valves held on the rod, the rod reciprocating between the first and second positions of the diverter to open and close the first and second valves.

A6. The syringe assembly of clause A1, wherein the diverter comprises a hydraulic actuator configured to move the diverter between the first and second positions.

A7. The syringe assembly of clause A1, wherein the diverter comprises a spool valve configured to move the diverter between the first and second positions.

A8. The syringe assembly of clause A1, wherein the syringe comprises an actuator configured to extend the piston.

A9. The syringe assembly of clause A1, wherein the syringe comprises an actuator configured to extend the piston when the diverter is in the second position.

Clause Set B:

B1. A fluid delivery device for a hydraulic fracturing system, said fluid delivery device comprising:

a fluid conduit comprising a fracking fluid outlet configured to be fluidly connected to a well head for delivering a fracking fluid to the well head, the fluid conduit comprising a base fluid inlet configured to be fluidly connected to an outlet of a frac pump of the hydraulic fracturing system;

a syringe having a material chamber fluidly connected to the fluid conduit downstream from the frac pump, the material chamber being configured to be fluidly connected to a material source, the syringe comprising a base fluid chamber, the syringe comprising a piston that is configured to retract to draw at least one material of the fracking fluid into the material chamber from the material source, the piston being configured to extend to push the at least one material of the fracking fluid from the material chamber into the fluid conduit; and a diverter fluidly connected to the base fluid chamber and moveable between first and second positions, wherein the first position of the diverter is configured to fluidly connect the base fluid chamber to a base fluid reservoir of the hydraulic fracturing system and fluidly disconnect the base fluid chamber from the outlet of the frac pump, and wherein the second position of the diverter is configured to fluidly connect the base fluid chamber to the outlet of the frac pump and fluidly disconnect the base fluid chamber from the base fluid reservoir.

B2. The fluid delivery device of clause B1, wherein the second position of the diverter is configured to approximately equalize the pressure of the base fluid chamber and the material chamber of the syringe.

B3. The fluid delivery device of clause B1, wherein the diverter comprises a rod and first and second valves held on the rod, the rod reciprocating between the first and second positions of the diverter to open and close the first and second valves.

B4. The fluid delivery device of clause B1, wherein the diverter comprises a hydraulic actuator configured to move the diverter between the first and second positions.

B5. The fluid delivery device of clause B1, wherein the syringe comprises an actuator configured to extend the piston.

Clause Set C:

C1. A method for operating a syringe of a hydraulic fracturing system, said method comprising:

fluidly connecting a base fluid chamber of the syringe with a base fluid reservoir to thereby draw at least one material of a fracking fluid into a material chamber of the syringe;

fluidly connecting the base fluid chamber of the syringe with an outlet of a frac pump of the hydraulic fracturing system to approximately equalize the pressure within the base fluid chamber and the material chamber; and actuating the syringe to inject the at least one material from the material chamber into a fluid conduit when the base fluid chamber of the syringe is fluidly connected to the outlet of the frac pump.

C2. The method of clause C1, wherein fluidly connecting the base fluid chamber of the syringe with the base fluid reservoir comprises fluidly connecting the base fluid chamber to a lower pressure line, and wherein fluidly connecting the base fluid chamber of the syringe with the outlet of the frac pump comprises fluidly connecting the base fluid chamber to a higher pressure line.

C3. The method of clause C1, wherein fluidly connecting the base fluid chamber of the syringe with the base fluid reservoir comprises moving a diverter to a first position wherein a first valve of the diverter is open and a second valve of the diverter is closed, and wherein fluidly connecting the base fluid chamber of the syringe with the outlet of the frac pump comprises moving the diverter to a second position wherein the second valve is open and the first valve is closed.

C4. The method of clause C1, wherein fluidly connecting the base fluid chamber of the syringe with the base fluid reservoir comprises retracting a piston of the syringe, and wherein actuating the syringe to inject the at least one material from the material chamber into the fluid conduit when the base fluid chamber is fluidly connected to the outlet of the frac pump comprises extending the piston using an actuator of the syringe.

C5. The method of clause C1, wherein fluidly connecting the base fluid chamber of the syringe with the base fluid reservoir comprises fluidly disconnecting the base fluid chamber of the syringe from the outlet of the frac pump, and wherein fluidly connecting the base fluid chamber of the syringe with the outlet of the frac pump comprises fluidly disconnecting the base fluid chamber of the syringe from the base fluid reservoir.

C6. The method of clause C1, wherein actuating the syringe to inject the at least one material from the material chamber into the fluid conduit when the base fluid chamber is fluidly connected to the outlet of the frac pump comprises injecting the at least one material into the fluid conduit downstream from the frac pump.

It is to be understood that the above description is intended to be illustrative, and not restrictive. For example, the above-described embodiments (and/or aspects thereof) can be used in combination with each other. Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Further, each independent feature or component of any given assembly can constitute an additional embodiment. In addition, many modifications can be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "clockwise" and "counterclockwise", "left" and right", "front" and "rear", "above" and "below" and the like are used as words of convenience to provide reference points and are not to be construed as limiting terms.

When introducing elements of aspects of the disclosure or the examples thereof, the articles "a," "an," "the," and "said" are intended to mean that there are one or more of the elements. The terms "comprising," "including," and "having" are intended to be inclusive and mean that there can be additional elements other than the listed elements. For example, in this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised", "comprises", "having", "has", "includes", and "including" where they appear. The term "exemplary" is intended to mean "an example of" The phrase "one or more of the following: A, B, and C" means "at least one of A and/or at least one of B and/or at least one of C." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Although the terms "step" and/or "block" may be used herein to connote different elements of methods employed, the terms should not be interpreted as implying any particular order among or between various steps herein disclosed unless and except when the order of individual steps is explicitly described. The order of execution or performance of the operations in examples of the disclosure illustrated and described herein is not essential, unless otherwise specified. The operations can be performed in any order, unless otherwise specified, and examples of the disclosure can include additional or fewer operations than those disclosed herein. It is therefore contemplated that executing or performing a particular operation before, contemporaneously with, or after another operation is within the scope of aspects of the disclosure.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A syringe assembly for a hydraulic fracturing system, said syringe assembly comprising:

a syringe having a material chamber, a base fluid chamber, and a piston, the material chamber being configured to be fluidly connected to a fluid conduit of the hydraulic fracturing system, the piston being configured to retract to draw at least one material into the material chamber, the piston being configured to extend to push the at least one material into the fluid conduit; and a diverter fluidly connected to the base fluid chamber and moveable between first and second positions, wherein the first position of the diverter is configured to fluidly connect the base fluid chamber to a base fluid reservoir of the hydraulic fracturing system and fluidly disconnect the base fluid chamber from an outlet of a frac pump of the hydraulic fracturing system, and wherein the second position of the diverter is configured to fluidly connect the base fluid chamber to the outlet of the frac pump and fluidly disconnect the base fluid chamber from the base fluid reservoir.

2. The syringe assembly of claim 1, wherein the second position of the diverter is configured to approximately equalize the pressure of the base fluid chamber and the material chamber of the syringe.

3. The syringe assembly of claim 1, wherein the second position of the diverter is configured to increase the pressure of fluid contained within the base fluid chamber of the syringe, the first position of the diverter being configured to release fluid from the base fluid chamber.

4. The syringe assembly of claim 1, wherein the diverter comprises first and second valves, the first valve being open and the second valve being closed in the first position of the diverter, the first valve being closed and the second valve being open in the second position of the diverter.

5. The syringe assembly of claim 1, wherein the diverter comprises a rod and first and second valves held on the rod, the rod reciprocating between the first and second positions of the diverter to open and close the first and second valves.

6. The syringe assembly of claim 1, wherein the diverter comprises a hydraulic actuator configured to move the diverter between the first and second positions.

7. The syringe assembly of claim 1, wherein the diverter comprises a spool valve configured to move the diverter between the first and second positions.

8. The syringe assembly of claim 1, wherein the syringe comprises an actuator configured to extend the piston.

9. The syringe assembly of claim 1, wherein the syringe comprises an actuator configured to extend the piston when the diverter is in the second position.

10. A fluid delivery device for a hydraulic fracturing system, said fluid delivery device comprising:

a fluid conduit comprising a fracking fluid outlet configured to be fluidly connected to a well head for delivering a fracking fluid to the well head, the fluid conduit comprising a base fluid inlet configured to be fluidly connected to an outlet of a frac pump of the hydraulic fracturing system;

a syringe having a material chamber fluidly connected to the fluid conduit downstream from the frac pump, the material chamber being configured to be fluidly connected to a material source, the syringe comprising a base fluid chamber, the syringe comprising a piston that is configured to retract to draw at least one material of the fracking fluid into the material chamber from the material source, the piston being configured to extend to push the at least one material of the fracking fluid from the material chamber into the fluid conduit; and a diverter fluidly connected to the base fluid chamber and moveable between first and second positions, wherein the first position of the diverter is configured to fluidly connect the base fluid chamber to a base fluid reservoir of the hydraulic fracturing system and fluidly disconnect the base fluid chamber from the outlet of the frac pump, and wherein the second position of the diverter is configured to fluidly connect the base fluid chamber to the outlet of the frac pump and fluidly disconnect the base fluid chamber from the base fluid reservoir.

11. The fluid delivery device of claim 10, wherein the second position of the diverter is configured to approximately equalize the pressure of the base fluid chamber and the material chamber of the syringe.

12. The fluid delivery device of claim 10, wherein the diverter comprises a rod and first and second valves held on the rod, the rod reciprocating between the first and second positions of the diverter to open and close the first and second valves.

13. The fluid delivery device of claim 10, wherein the diverter comprises a hydraulic actuator configured to move the diverter between the first and second positions.

14. The fluid delivery device of claim 10, wherein the syringe comprises an actuator configured to extend the piston.

15. A method for operating a syringe of a hydraulic fracturing system, the method comprising:

fluidly connecting a base fluid chamber of the syringe with a base fluid reservoir to draw at least one material of a fracking fluid into a material chamber of the syringe, wherein fluidly connecting the base fluid chamber of the syringe with the base fluid reservoir comprises moving a diverter to a first position wherein a first valve of the diverter is open and a second valve of the diverter is closed;

fluidly connecting the base fluid chamber of the syringe with an outlet of a frac pump of the hydraulic fracturing system to approximately equalize the pressure within the base fluid chamber and the material chamber, wherein fluidly connecting the base fluid chamber of the syringe with the outlet of the frac pump comprises moving the diverter to a second position wherein the second valve is open and the first valve is closed; and actuating the syringe to inject the at least one material from the material chamber into a fluid conduit when the base fluid chamber of the syringe is fluidly connected to the outlet of the frac pump.

16. The method of claim 15, wherein fluidly connecting the base fluid chamber of the syringe with the base fluid reservoir comprises fluidly connecting the base fluid chamber to a lower pressure line, and wherein fluidly connecting the base fluid chamber of the syringe with the outlet of the frac pump comprises fluidly connecting the base fluid chamber to a higher pressure line.

17. The method of claim 15, wherein fluidly connecting the base fluid chamber of the syringe with the base fluid reservoir comprises retracting a piston of the syringe, and wherein actuating the syringe to inject the at least one material from the material chamber into the fluid conduit when the base fluid chamber is fluidly connected to the outlet of the frac pump comprises extending the piston using an actuator of the syringe.

18. The method of claim 15, wherein fluidly connecting the base fluid chamber of the syringe with the base fluid reservoir comprises fluidly disconnecting the base fluid chamber of the syringe from the outlet of the frac pump, and wherein fluidly connecting the base fluid chamber of the syringe with the outlet of the frac pump comprises fluidly disconnecting the base fluid chamber of the syringe from the base fluid reservoir.

19. The method of claim 15, wherein actuating the syringe to inject the at least one material from the material chamber into the fluid conduit when the base fluid chamber is fluidly connected to the outlet of the frac pump comprises injecting the at least one material into the fluid conduit downstream from the frac pump.

* * * * *